US011776558B1

(12) United States Patent
Sigwanz et al.

(10) Patent No.: US 11,776,558 B1
(45) Date of Patent: Oct. 3, 2023

(54) SYSTEMS AND METHODS FOR GENERATING AND/OR IMPLEMENTING A MODIFIED AUDIOGRAM

(71) Applicant: SONOVA AG, Staefa (CH)

(72) Inventors: Ullrich Sigwanz, Hombrechtikon (CH); Robert Baur, Männedorf (CH)

(73) Assignee: Sonova AG, Staefa (CH)

( * ) Notice: Subject to any disclaimer, the term of this patent is extended or adjusted under 35 U.S.C. 154(b) by 18 days.

(21) Appl. No.: 17/701,223

(22) Filed: Mar. 22, 2022

(51) Int. Cl.
*H04R 25/00* (2006.01)
*G10L 21/0332* (2013.01)
*G10L 21/14* (2013.01)

(52) U.S. Cl.
CPC ..... *G10L 21/0332* (2013.01); *G10L 21/14* (2013.01); *H04R 25/353* (2013.01); *H04R 25/505* (2013.01)

(58) Field of Classification Search
CPC ..... H04R 25/353; H04R 25/505; G10L 21/14; G10L 21/0332
See application file for complete search history.

(56) References Cited

U.S. PATENT DOCUMENTS 5,553,151 A * 9/1996 Goldberg ..... H04R 25/356 381/312
2004/0264721 A1* 12/2004 Allegro ..... H04R 25/353 381/316
2008/0177539 A1* 7/2008 Huang ..... G10L 21/038 704/E21.011

OTHER PUBLICATIONS

Scollie, et al.,"Fitting Frequency-Lowering Signal Processing Applying the American Academy of Audiology Pediatric Amplification Guideline: Updates and Protocols", Journal of the American Academy of Audiology; vol. 27, No. 3, Mar. 2016, pp. 219-236(18)).

* cited by examiner

*Primary Examiner* — Tuan D Nguyen
(74) *Attorney, Agent, or Firm* — ALG Intellectual Property, LLC

(57) ABSTRACT

An exemplary system includes a processor communicatively coupled to a memory and configured to execute instructions to generate a modified audiogram for a user of a hearing device. The modified audiogram may be based on a frequency lowering scheme that maps at least some audio frequencies included in a first set of audio frequencies to relatively lower audio frequencies to form a second set of audio frequencies. The modified audiogram may indicate a set of modified hearing thresholds of the user at the first set of audio frequencies. The generating of the modified audiogram may include applying an inverse of the frequency lowering scheme to the set of modified hearing thresholds at the second set of audio frequencies to obtain the set of modified hearing thresholds of the modified audiogram at the first set of audio frequencies.

20 Claims, 26 Drawing Sheets

SYSTEMS AND METHODS FOR GENERATING AND/OR IMPLEMENTING A MODIFIED AUDIOGRAM

BACKGROUND INFORMATION

Hearing devices (e.g., hearing aids) are used to improve the hearing capability and/or communication capability of users of the hearing devices. Such hearing devices are configured to process a received input sound signal (e.g., ambient sound) and provide the processed input sound signal to the user (e.g., by way of a receiver (e.g., a speaker) placed in the user's ear canal or at any other suitable location).

When a hearing device is initially provided to a user, and during follow-up tests and checkups thereafter, it is usually necessary to "fit" the hearing device to the user. Fitting of a hearing device to a user is typically performed by an audiologist or the like who presents various stimuli having different loudness levels to the user. The audiologist relies on subjective feedback from the user as to how such stimuli are perceived. The subjective feedback may then be used to generate an audiogram that indicates individual hearing thresholds and loudness comfort levels of the user.

An audiogram of a user of a hearing device typically includes a typically sloping hearing loss profile where a user's ability to perceive sound decreases with an increase in frequency. Because of this, the amount of gain needed for the user to perceive sounds at certain high frequency ranges is often larger than the hearing device is capable of providing. To facilitate the user perceiving sounds at such high frequency ranges, the hearing device may implement a frequency lowering scheme that is generally configured to map higher frequencies, that are, based on the audiogram of the user, predicted to be inaudible to a user, to lower frequencies that are, based on the audiogram of the user, predicted to be audible. However, application of a frequency lowering scheme changes the audibility of sound for a user of a hearing device at the lower frequencies. This change in audibility may result in an incorrect amount of gain being applied in certain frequency ranges, thereby causing sounds at certain frequencies to be too loud for the user while sounds at other frequencies may not be loud enough for the user to perceive.

For at least the foregoing reasons, conventional fitting procedures or models using a frequency lowering scheme based on a conventional audiogram representing the hearing thresholds of a user across a relevant audio frequency range are inadequate to fit a hearing device to the user.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION

Figure 1:
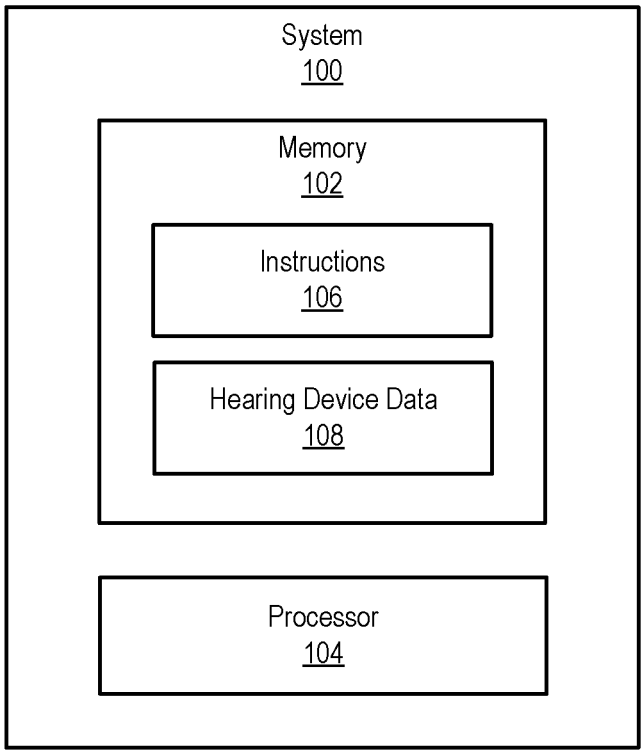
FIG. 1 illustrates an exemplary system that may be implemented according to principles described herein.

Systems and methods for generating and/or implementing a modified audiogram are described herein. Systems and methods such as those described herein are based on the insight that, by providing for a modified audiogram (e.g., a frequency lowering scheme-based audiogram according to the disclosure herein), conventional fitting procedures can be applied to the modified audiogram to obtain a valid fitting prescription taking into account the frequency lowering scheme and an audibility mismatch resulting from different hearing thresholds in an input frequency range (e.g., the frequency range in which ambient sounds reach the user of the hearing device) and the frequency lowered output frequency range (e.g., the frequency range to which the frequency lowering scheme maps the input frequencies and in which the frequency lowered sounds are provided to the user).

As will be described in more detail below, an exemplary system may comprise a memory storing instructions and a processor communicatively coupled to the memory and configured to execute the instructions to generate a modified audiogram for a user of a hearing device. The modified audiogram may be based on a frequency lowering scheme that may map at least some audio frequencies included in a first set of audio frequencies to relatively lower audio frequencies to form a second set of audio frequencies. The modified audiogram may indicate a set of modified hearing thresholds of the user at the first set of audio frequencies, which set of modified hearing thresholds may be based on a set of hearing thresholds of the user at the second set of audio frequencies. The generating of the modified audiogram may include applying an inverse of the frequency lowering scheme to the set of modified hearing thresholds at the second set of audio frequencies to obtain the set of modified hearing thresholds of the modified audiogram at the first set of audio frequencies. In certain examples, the generating of the modified audiogram may further include applying the frequency lowering scheme to a set of reference hearing thresholds at the first set of audio frequencies to obtain frequency lowered reference hearing thresholds at the second set of audio frequencies and determining, based on the frequency lowered reference hearing thresholds and the set of hearing thresholds of the user at the second set of audio frequencies, the set of modified hearing thresholds at the second set of audio frequencies.

In another exemplary system, the processor may be configured to execute the instructions to access a modified audiogram for a user of a hearing device, determine, based on the modified audiogram and an input frequency-based target gain generation model, one or more target gain values for the user of the hearing device, and fit the hearing device to the user based on the one or more target gain values.

By providing systems and methods such as those described herein, it may be possible to improve a fitting of a hearing device to a user through implementation of a modified audiogram. For example, systems and methods such as those described herein may facilitate determining how frequency lowering affects hearing thresholds of a user of a hearing device and using that information to improve a fitting of the hearing device to the user as compared to conventional methods. In addition, the systems and methods described herein may facilitate more easily (e.g., with less calculations) and more clearly determining an optimal amount of frequency lowering to be applied for a user of a hearing device. For example, instead of having to go through the process of performing different iterative pre-calculations at the start of a fitting process, it is possible to consider the maximum output capabilities of the hearing device and iteratively test one or more target gain curves to optimize the amount of frequency lowering. Moreover, systems and methods such as those described herein may beneficially render a calculation, based on a chosen frequency lowering setting, of an amount of gain an independent, explainable, and reproducible step. Further, systems and methods such as those described herein may allow the application of conventional fitting models (e.g., National Acoustic Laboratories ("NAL")-NL2 or Desired Sensation Level ("DSL")-V2) to obtain a valid fitting prescription for hearing devices using a frequency lowering scheme. Other benefits of the systems and methods described herein will be made apparent herein.

FIG. 1 illustrates an exemplary system 100 that may be implemented according to principles described herein. System 100 may be implemented by any number of computing devices, such as one or more fitting devices, personal computers, mobile devices (e.g., a smartphone or a table computer), etc. As shown, system 100 may include, without limitation, a memory 102 and a processor 104 selectively and communicatively coupled to one another. Memory 102 and processor 104 may each include or be implemented by hardware and/or software components (e.g., processors, memories, communication interfaces, instructions stored in memory for execution by the processors, etc.). In some examples, memory 102 and processor 104 may be distributed between multiple devices (e.g., multiple computing devices) and/or multiple locations as may serve a particular implementation.

Memory 102 may maintain (e.g., store) executable data used by processor 104 to perform any of the operations associated with system 100 described herein. For example, memory 102 may store instructions 106 that may be executed by processor 104 to perform any of the operations associated with system 100 described herein. Instructions 106 may be implemented by any suitable application, software, code, and/or other executable data instance.

As shown in FIG. 1, memory 102 may also store hearing device data 108 that may include any suitable data associated with a hearing device that may be communicatively coupled to system 100. For example, hearing device data 108 may include any suitable settings, control parameters, operating programs, frequency lowering schemes, fitting programs, hearing thresholds, target gain curves, etc. that may be associated with a hearing device communicatively coupled to system 100 and/or a user of the hearing device. In certain examples, hearing device data 108 may include data that is specific to a particular user of a hearing device. For example, hearing device data 108 may include data associated with one or more target gain profiles associated with a particular user.

Memory 102 may also maintain any data received, generated, managed, used, and/or transmitted by processor 104. For example, memory 102 may maintain any data suitable to facilitate communications (e.g., wired and/or wireless communications) between system 100 and one or more hearing devices, such as those described herein. Memory 102 may maintain additional or alternative data in other implementations.

Processor 104 is configured to perform any suitable processing operation that may be associated with system 100. For example, processor 104 may be configured to perform (e.g., execute instructions 106 stored in memory 102 to perform) various processing operations associated with generating and/or implementing a modified audiogram. For example, such processing operations may include accessing a modified audiogram, determining, based on the modified audiogram and an input frequency-based target gain generation model, one or more target gain values for a user of a hearing device, and fitting the hearing device to the user based on the one or more target gain values. In certain examples, such processing operations may include providing one or more graphical user interfaces such as those described herein for display to a user to facilitate a user (e.g., an audiologist) fitting a hearing device to a user based on a modified audiogram. These and other operations that may be performed by processor 104 are described herein.

Figure 2:
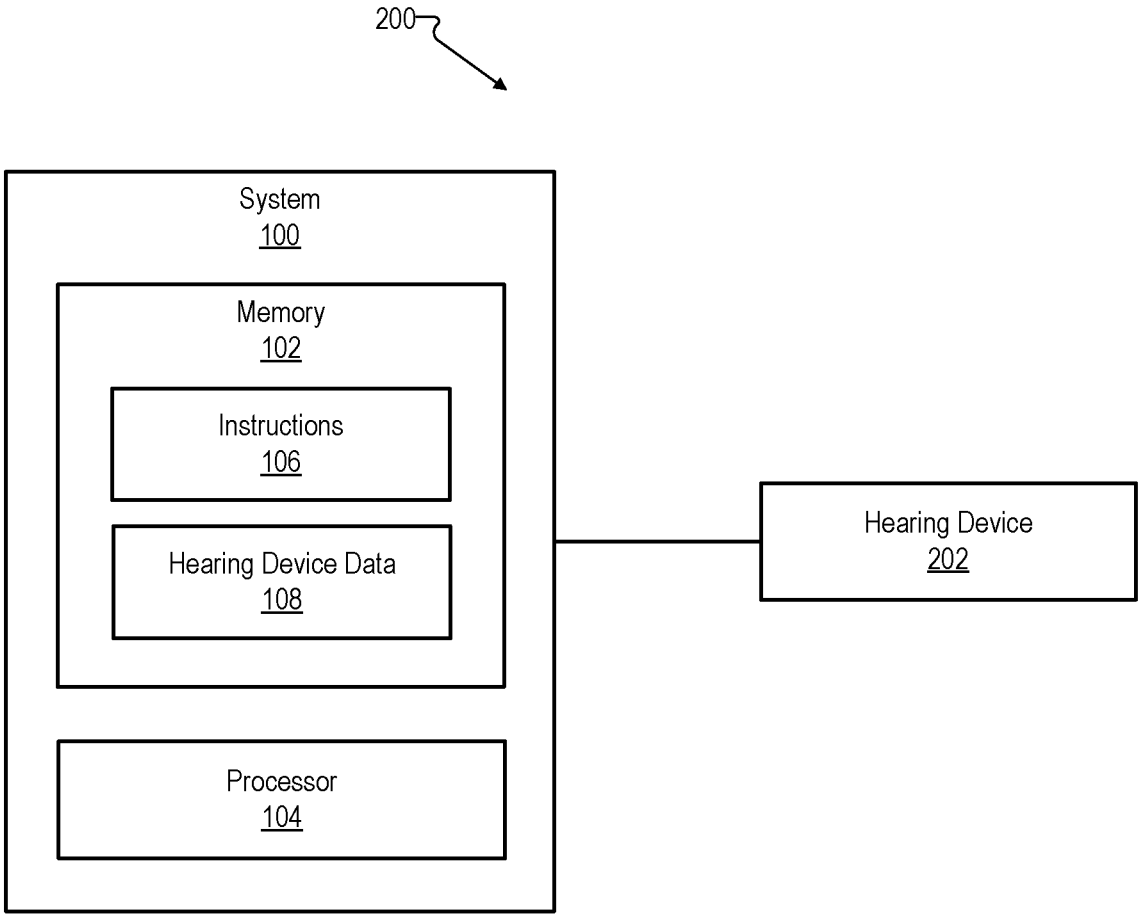
FIG. 2 illustrates an exemplary implementation of the system of FIG. 1 according to principles described herein.

FIG. 2 shows an exemplary configuration 200 in which system 100 may be implemented. As shown in FIG. 2, system 100 is communicatively coupled to a hearing device 202. As used herein, a "hearing device" may be implemented by any device configured to provide or enhance hearing to a user. For example, a hearing device may be implemented by one or more hearing aids configured to amplify audio content to a user, a sound processor included in a cochlear implant system configured to apply electrical stimulation representative of audio content to a user, a sound processor included in a stimulation system configured to apply electrical and acoustic stimulation to a user, or any other suitable hearing prosthesis or combination of hearing prostheses. In some examples, a hearing device may be implemented by a behind-the-ear ("BTE") hearing device configured to be worn behind an ear and/or at least partially within an ear canal of a user.

System 100 may be communicatively coupled to hearing device 202 in any suitable manner and through any suitable communication interface. For example, system 100 may be wirelessly connected to hearing device 202 using any suitable wireless communication protocol. Alternatively, system 100 may be communicatively coupled to hearing device 202 by way of a wired connection.

Although only one hearing device 202 is shown in FIG. 2, it is understood that hearing device 202 may be included in a system that includes more than one hearing device configured to provide or enhance hearing to a user. For example, hearing device 202 may be included in a binaural hearing system that includes two hearing devices, one for each ear. In such examples, hearing device 202 may be provided behind, for example, the left ear of the user and an additional hearing device may be provided behind the right ear of the user. When hearing device 202 is included as part of a binaural hearing system, hearing device 202 may communicate with the additional hearing device by way of a binaural communication link that interconnects hearing device 202 with the additional hearing device. Such a binaural communication link may include any suitable wireless or wired communication link as may serve a particular implementation.

While system 100 is communicatively coupled to hearing device 202, system 100 (e.g., processor 104) may provide various graphical user interfaces for display by a display device to facilitate fitting hearing device 202 to a user. System 100 may provide such graphical user interfaces for display at any suitable time and on any suitable display device that may be part of or communicatively coupled to system 100. For example, such graphical user interfaces may be provided for display to a user by way of a laptop computer, a tablet computer, a smartphone, etc. that may be communicatively coupled to system 100.

Hearing device 202 may be fit to a user based on an audiogram of the user. An audiogram may be depicted as a graph that shows results of a pure-tone hearing test. Audiograms show how loud sounds need to be at different frequencies for a user of hearing device 202 to hear the sounds. An audiogram may indicate a first set of hearing thresholds, for the user, at a first set of audio frequencies (e.g., across a range of audio frequencies from 125 Hz to 8 kHz). An audiogram of a user of hearing device 202 may typically indicate that the user has better audibility in a relatively lower frequency range (e.g., between 125 Hz and 1 kHz) and degraded audibility at higher frequencies (e.g., between 1 kHz and 8 kHz). In view of this, system 100 may implement a frequency lowering scheme to restore audibility of high frequencies for a user. For example, system 100 may apply a frequency lowering scheme that maps at least some audio frequencies included in a first set of audio frequencies to relatively lower audio frequencies to form a second set of audio frequencies. System 100 may implement any suitable type of frequency lowering scheme as may serve a particular implementation. Exemplary types of frequency lowering schemes may include a frequency compression scheme, (e.g., non-linear frequency compression, adaptive non-linear frequency compression, linear frequency compression, etc.), a frequency transposition scheme, a frequency composition scheme, or any other suitable type of frequency lowering scheme.

Although frequency lowering schemes such as those described herein may facilitate a user of hearing device 202 perceiving otherwise unperceivable high frequency sounds, such frequency lowering schemes may undesirably change the audibility of the user. Accordingly, system 100 may implement a modified audiogram (also referred to as a frequency lowering scheme-based audiogram) in place of the audiogram to fit hearing device 202 to the user. Such a modified audiogram may be based on the audiogram but may be changed such as described herein to compensate for the changes in audibility of the user that may be caused by application of a frequency lowering scheme. Such a modified audiogram may indicate a set of modified hearing thresholds of a user at the first set of audio frequencies, which set of modified hearing thresholds may be based on a set of hearing thresholds of the user at the second set of audio frequencies.

In certain examples, system 100 may access a modified audiogram from any suitable source to facilitate fitting hearing device 202 to a user. For example, system 100 may receive an already generated modified audiogram from a third party (e.g., a hearing care professional, an audiologist, etc.) in certain examples.

In certain alternative examples, system 100 may generate a modified audiogram. This may be accomplished in any suitable manner. For example, system 100 may apply a frequency lowering scheme to a set of reference hearing thresholds at the first set of audio frequencies. As used herein, a "set of reference hearing thresholds" may represent any suitable gain-dependent hearing thresholds of a reference user with "normal" hearing capability. In certain examples, a set of reference hearing thresholds across a range of audio frequencies may correspond to a 0 dB hearing level of an idealized or standardized "normal" person (e.g., person with "normal" hearing capability), a hearing threshold level ("HTL") in general, an isophone, a most comfortable level ("MCL"), an uncomfort level ("UCL"), or any other suitable reference level.

System 100 may apply a frequency lowering scheme to a set of reference hearing thresholds in any suitable manner. For example, in certain implementations, system 100 may apply frequency compression to the set of reference hearing thresholds. In certain implementations, system 100 may apply one or more mappings (e.g., compression, shifting, translation, etc.) when implementing, for example, an adaptive frequency compression scheme. For example, system 100 may perform a first mapping from a first set of audio frequencies to a second set of audio frequencies, a second mapping from the second set of audio frequencies to an audiogram of the user, and a third mapping from the audiogram of the user to the first set of audio frequencies. Specific examples of how the frequency lowering scheme may be applied to a set of reference hearing thresholds are described further herein.

System 100 may apply a frequency lowering scheme to a set of reference hearing thresholds to obtain frequency lowered reference hearing thresholds at a second set of audio frequencies. Such frequency lowered reference hearing thresholds may be indicative of changes that may occur to the set of reference hearing thresholds as a result of applying the frequency lowering scheme. Based on the frequency lowered hearing thresholds, system 100 may determine a set of modified hearing thresholds, for the user, at the second set of audio frequencies.

System 100 may determine the set of modified hearing thresholds in any suitable manner. For example, in certain implementations, the determining of the set of modified hearing thresholds may include determining a correction amount between the set of reference hearing thresholds at the second set of audio frequencies and the frequency lowered reference hearing thresholds across the second set of audio frequencies. In certain examples, the correction amount may include a plurality of correction amounts across a range of audio frequencies. For example, system 100 may determine a first correction amount corresponding to a first frequency included in the second set of audio frequencies, a second correction amount corresponding to a second frequency included in the second set of audio frequencies, third correction amount corresponding to a third frequency included in the second set of audio frequencies, and so forth. System 100 may determine any suitable number of correction amounts across a range of audio frequencies as may serve a particular implementation.

After system 100 determines one or more correction amounts, system 100 may apply the one or more correction amounts to the set of hearing thresholds across the second set of audio frequencies any suitable manner. For example, system 100 may increase at least some of the hearing thresholds included in set of hearing thresholds and/or decrease at least some hearing thresholds included in the set of hearing thresholds to determine the set of modified hearing thresholds for the user of the hearing device.

After system 100 determines the set of modified hearing thresholds, system 100 may associate the set of modified hearing thresholds at the second set of audio frequencies with the first set of audio frequencies such that the modified audiogram represents the set of modified hearing thresholds, for the user, at the first set of audio frequencies. System 100 may associate the set of modified hearing thresholds with the first set of audio frequencies in any suitable manner. For example, in certain implementations, system 100 may apply an inverse of the frequency lowering scheme to the set of modified hearing thresholds at the second set of audio frequencies to obtain the set of modified hearing thresholds of the modified audiogram at the first set of audio frequencies. Specific examples of how system 100 may apply an inverse of the frequency lowering scheme are described further herein.

Instead of system 100 using the audiogram of the user, system 100 may use the modified audiogram as an input to an input frequency-based target gain generation model to fit hearing device 202 to the user. As used herein, an "input frequency-based target gain generation model" may refer to any suitable fitting formula, prescription procedure, algorithm, etc. that may be used to fit hearing device 202 to the user. For example, system 100 may implement any suitable DSL prescription formula or any suitable prescription procedure from NAL as an input frequency-based target gain generation model.

Based on an input frequency-based target gain generation model and the modified audiogram, system 100 may generate one or more target gain values for the user of hearing device 202. Such target gain values may indicate an amount of gain necessary for a user of hearing device 202 to perceive sound at a particular audio frequency. In certain examples, system 100 may determine a target gain curve that represents a target gain profile for useable gain by hearing device 202 across a range of audio frequencies.

In certain implementations, the target gain curve may include a plurality of target gain curves. For example, the plurality of target gain curves may include a first target gain curve, a second target gain curve, and a third target gain curve. System 100 may determine any suitable number of target gain curves as may serve a particular implementation. Each target gain curve may represent a different target gain profile for the useable gain by hearing device 202 across a range of audio frequencies. In addition, each target gain curve may correspond to a different sound input level included in a plurality of sound input levels. For example, the first target gain curve may correspond to an 80 dB sound input level, the second target gain curve may correspond to a 65 dB sound input level, and the third target gain curve may correspond to a 50 dB sound input level. Each target gain profile may be specific to a particular user of hearing device 202. Exemplary target gain curves are described further herein.

Figure 3:
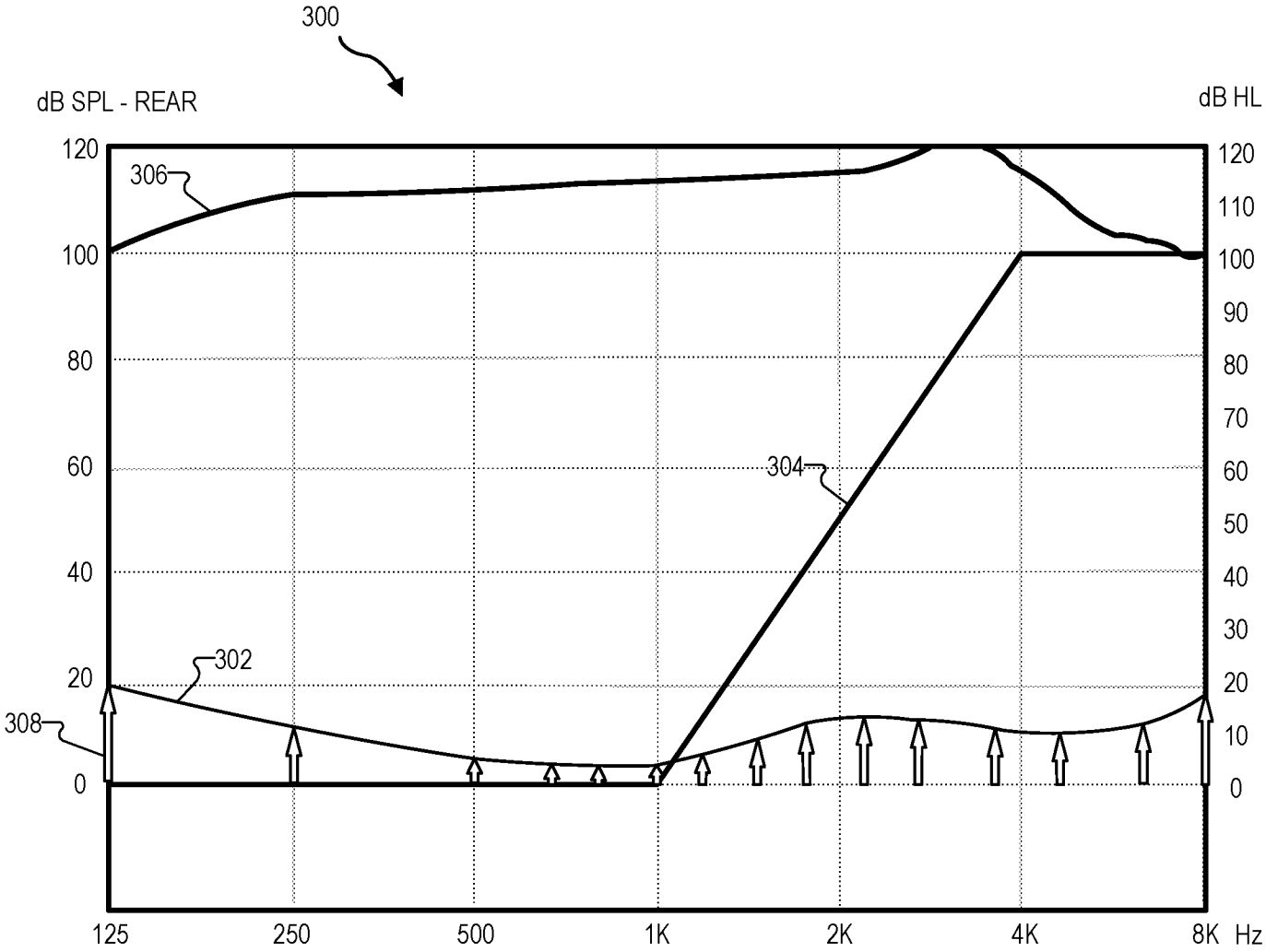
FIGS. 3-14 illustrate exemplary graphs that depict how a modified audiogram may be generated based on application of a frequency compression scheme according to principles described herein.

FIGS. 3-14 illustrate exemplary graphs that depict how a modified audiogram may be generated based on an applied frequency compression scheme. As shown in FIG. 3, graph 300 depicts frequency along the horizontal axis, sound pressure level along the left vertical axis, and an amount of gain along the right vertical axis. FIG. 3 further shows a reference hearing threshold curve 302, an audiogram curve 304, and a maximum output limit curve 306. Reference hearing threshold curve 302 may represent sound pressure levels at an ear drum (dB SPL) at which a person with "normal" hearing is just able to perceive sounds across the range of audio frequencies shown in FIG. 3. Reverence hearing threshold curve 302 may be considered as a 0 dB hearing level for the person with "normal" hearing. An audiogram (not shown) of the person with "normal" hearing would extend horizontally from 0 dB as a flat line across the range of audio frequencies depicted in FIG. 3

Audiogram curve 304 may represent an audiogram of a user of hearing device 202. Audiogram curve 304 depicts hearing thresholds for the user of hearing device 202 across the range of audio frequencies shown in FIG. 3. As shown in FIG. 3, audiogram curve 304 indicates that the user of hearing device 202 may have "normal" hearing from 125 Hz to 1 kHz. However, the audibility of the user decreases from 1 kHz to 8 kHz.

Curve 306 may represent the maximum output capacity of hearing device 202.

Arrow 308 and the other arrows depicted in FIG. 3 represent level differences that may be added to audiogram curve 304 to calculate sound pressure threshold levels at the ear drum for the user of hearing device 202 to just perceive sound at different audio frequencies. For example, arrow 308 shows the sound pressure threshold needed at the ear drum of both the person with "normal" hearing and the user of hearing device 202 to just perceive sound provided at 125 Hz.

Figure 4:
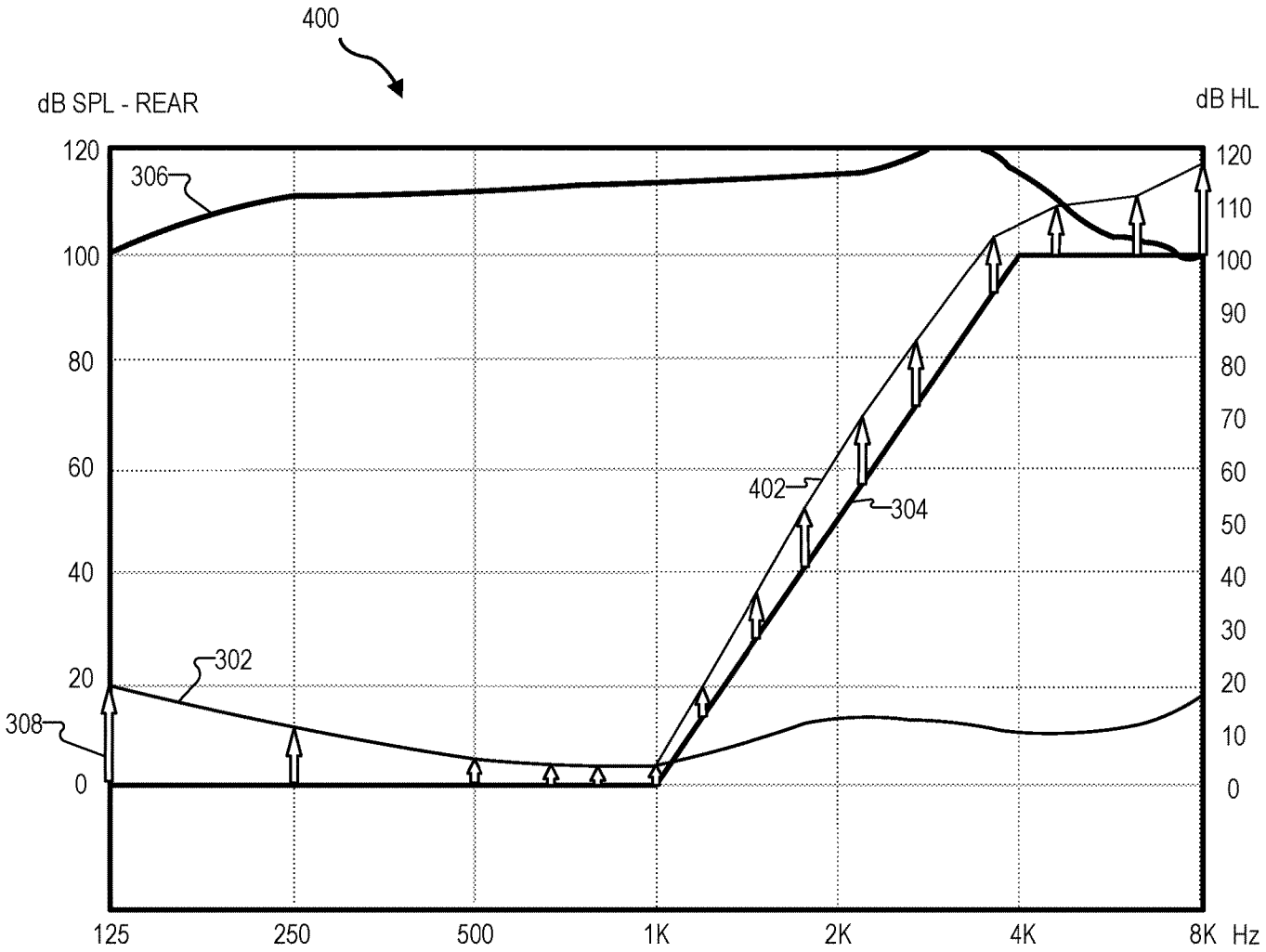

FIG. 4 depicts a graph 400 showing a transformation may be performed by system 100 to generate a sound pressure level curve 402 (also referred to as an SPLogram) of the user of hearing device 202. As shown in FIG. 4, the transformation may be performed by adding the arrows between 1 kHz and 8K to audiogram curve 304 to generate sound pressure level curve 402. Sound pressure level curve 402 may indicate the sound pressure levels needed at the ear drum of the user of hearing device 202 for the user to perceive sounds across the range of frequencies shown in FIG. 4.

Figure 5:
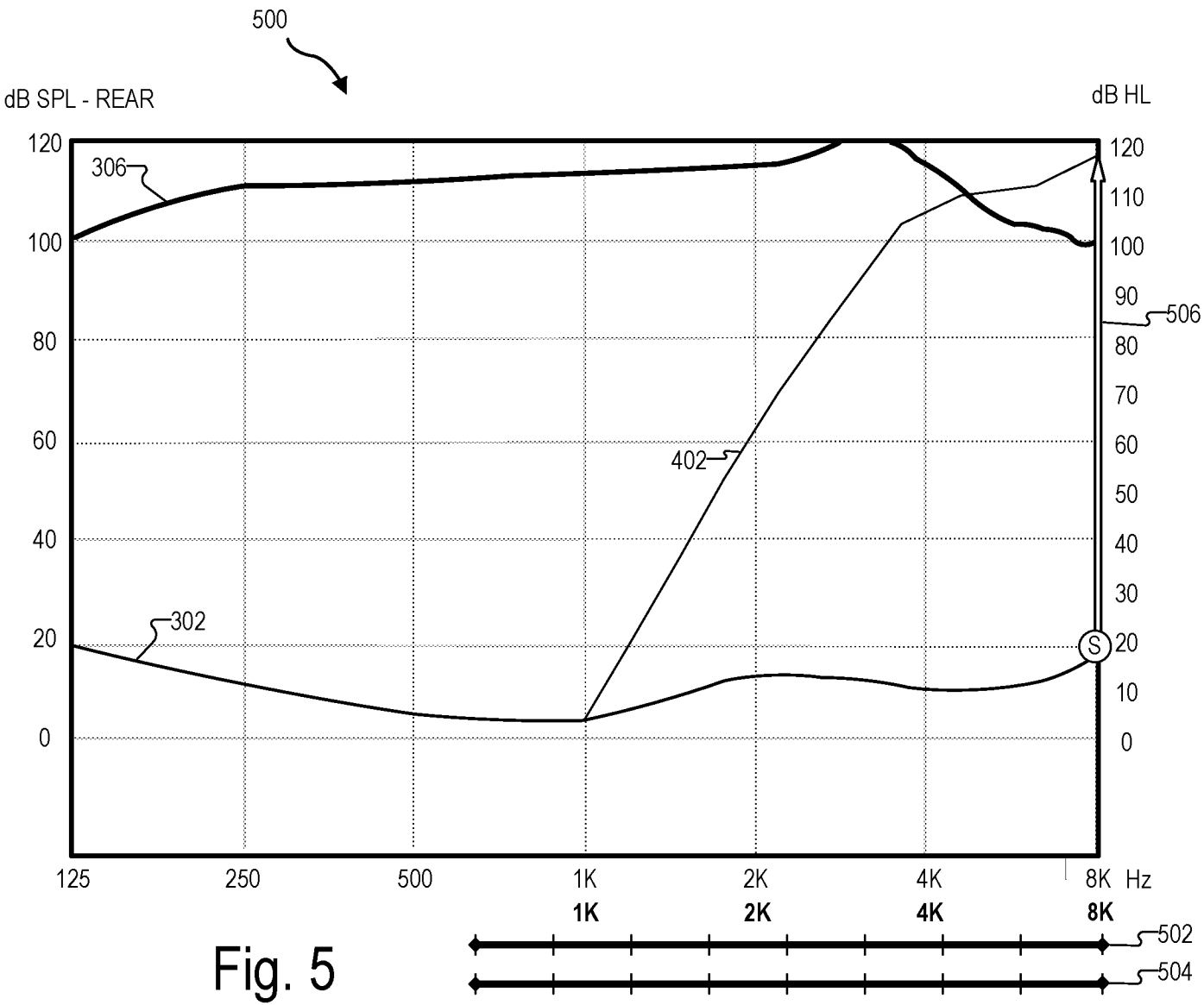

FIG. 5 depicts a graph 500 showing reference hearing threshold curve 302 and sound pressure level curve 402 when no frequency compression is applied. As shown in FIG. 5, a line graph 502 depicts a compressible range of audio frequencies and a line graph 504 depicts a compressed range. Because line graph 502 and line graph 504 are the same length in FIG. 5, it is understood that no frequency compression is currently applied. Arrow 506 shown in FIG. 5 depicts an amount of gain/amplification that may be needed for the user of hearing device 202 to just perceive a soft "S" sound at 8 kHz. As shown in FIG. 5, it would require approximately 90 dB of gain for the user of hearing device 202 to perceive the soft "S" sound, which is more gain than hearing device 202 may be able to provide.

Figure 6:
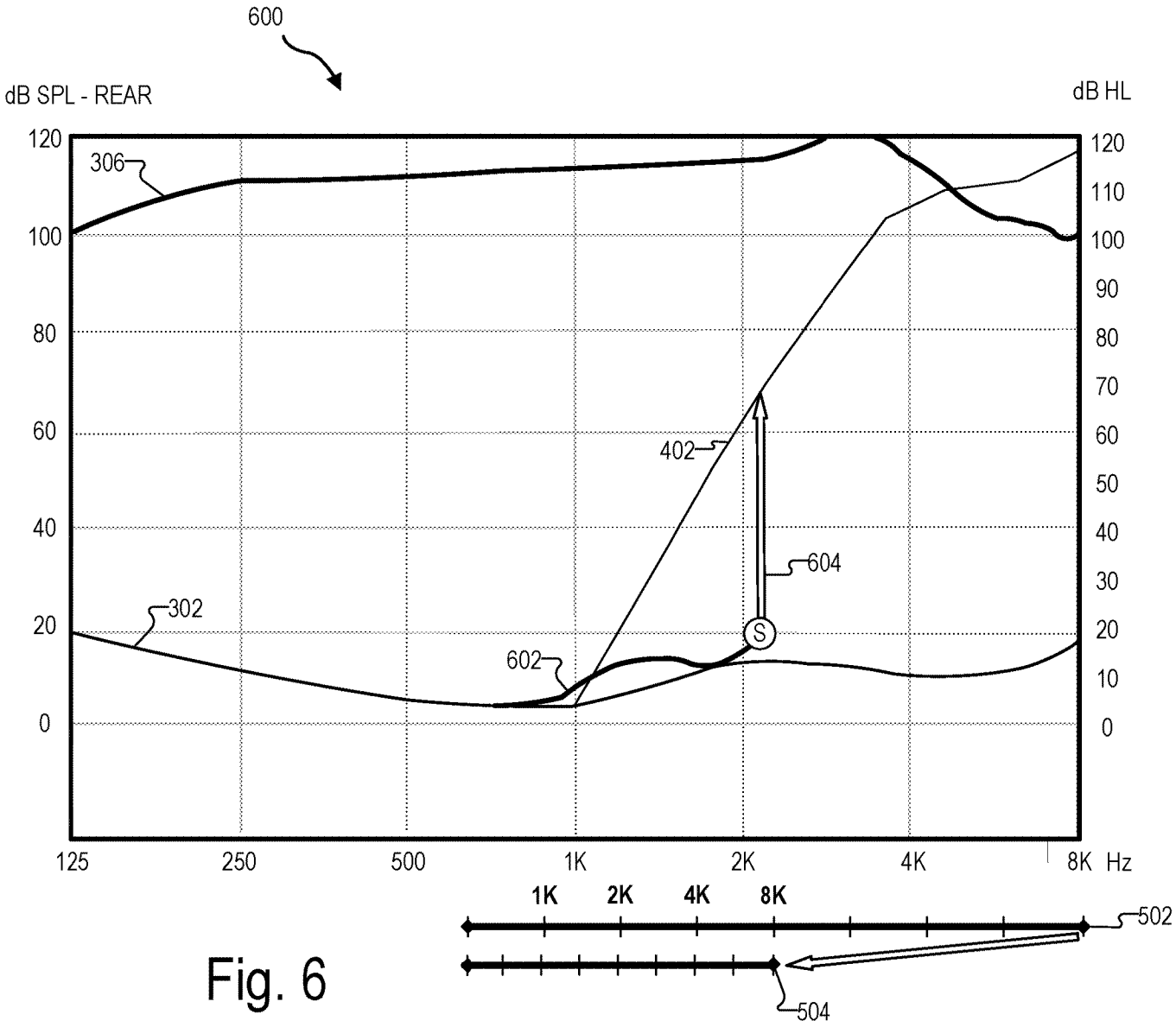

In view of this, system 100 may apply a frequency compression scheme to reference hearing threshold curve 302. This is shown in FIG. 6, which depicts a graph 600 showing line graph 504 being compressed with respect to line graph 502. As a result of the frequency compression, reference hearing threshold curve 302 is compressed to form a compressed reference hearing threshold curve 602 that depicts frequency lowered reference thresholds at a set of audio frequencies associated with the frequency compression.

Arrow 604 in FIG. 6 shows that an amount of gain required for the user of hearing device 202 to perceive a soft "S" is significantly less than that depicted in FIG. 5. In so doing, it is possible to remap the soft "S" sound from 8 kHz where the soft "S" sound is predicted to be inaudible to the user of hearing device 202 to approximately 2.5 kHz where the soft "S" sound is predicted to be audible with the appropriate amount of gain depicted by arrow 604. However, as shown in FIG. 6, applying frequency compression to reference hearing threshold curve 302 results in a compressed reference hearing threshold curve 602 that is distorted. Based on the distortion, the compressed "S" and sounds associated with other frequencies may be too loud for a person with "normal" hearing and, as a result, may also be too loud for the user of hearing device 202.

Figure 7:
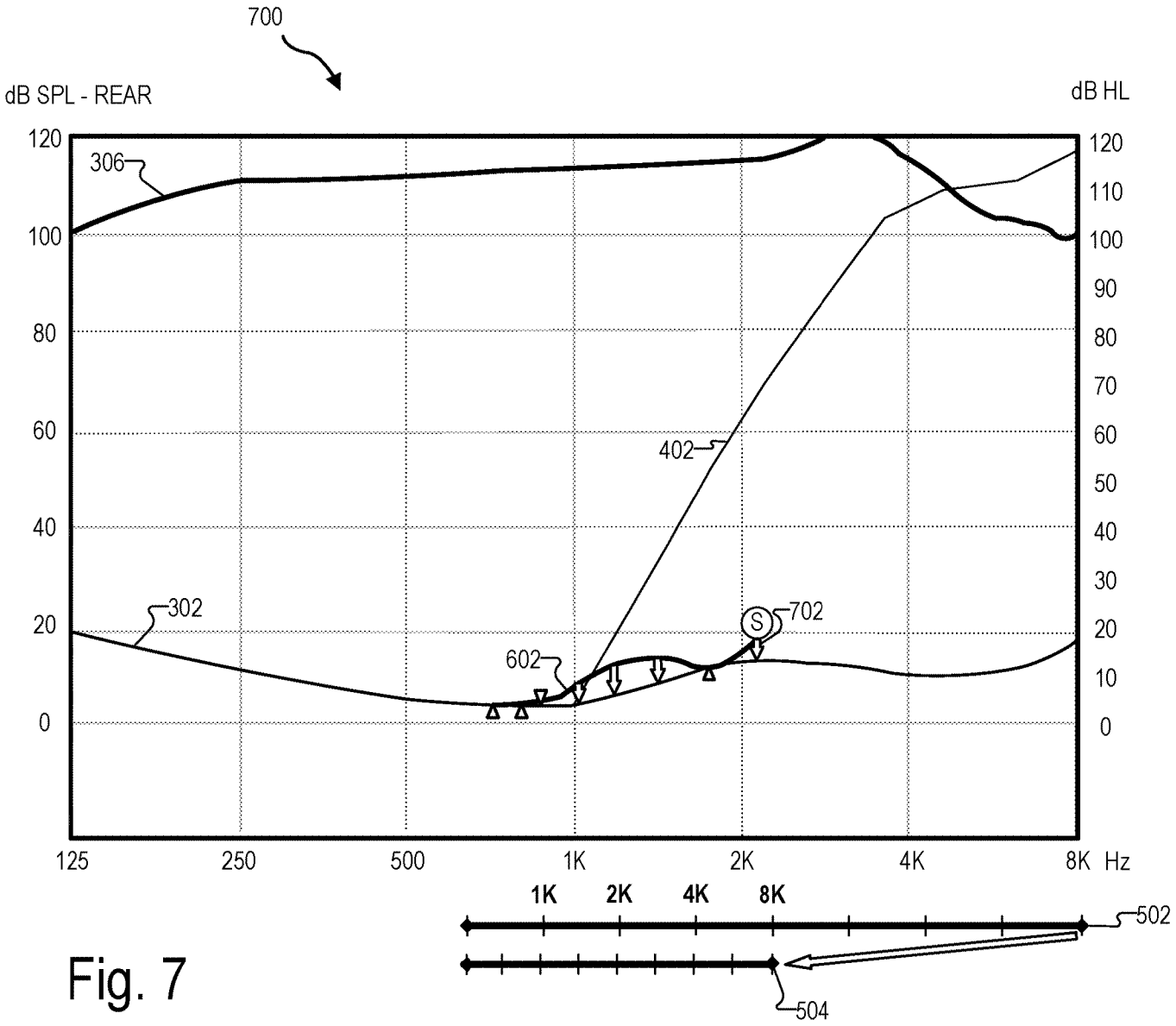

To correct for the distortion shown in FIG. 6, system 100 may determine a plurality of correction amounts to be applied to compressed reference hearing threshold curve 602 based on the distortion. This is depicted in FIG. 7, which shows a graph 700 and a plurality of arrows representing the correction amounts along compressed reference hearing threshold curve 602. For example, an arrow 702 shown in FIG. 7 represents a correction amount that is associated with the compressed soft "S".

System 100 may apply the correction amounts shown in FIG. 7 to sound pressure level curve 402 to determine modified hearing thresholds, for the user of hearing device 202, at the set of audio frequencies associated with the frequency compression. This is shown in FIG. 8, which depicts a graph 800 showing a modified sound pressure level curve 802 that has been modified based on the correction amounts represented by the arrows along compressed reference hearing threshold curve 602 shown in FIG. 8.

Figure 8:
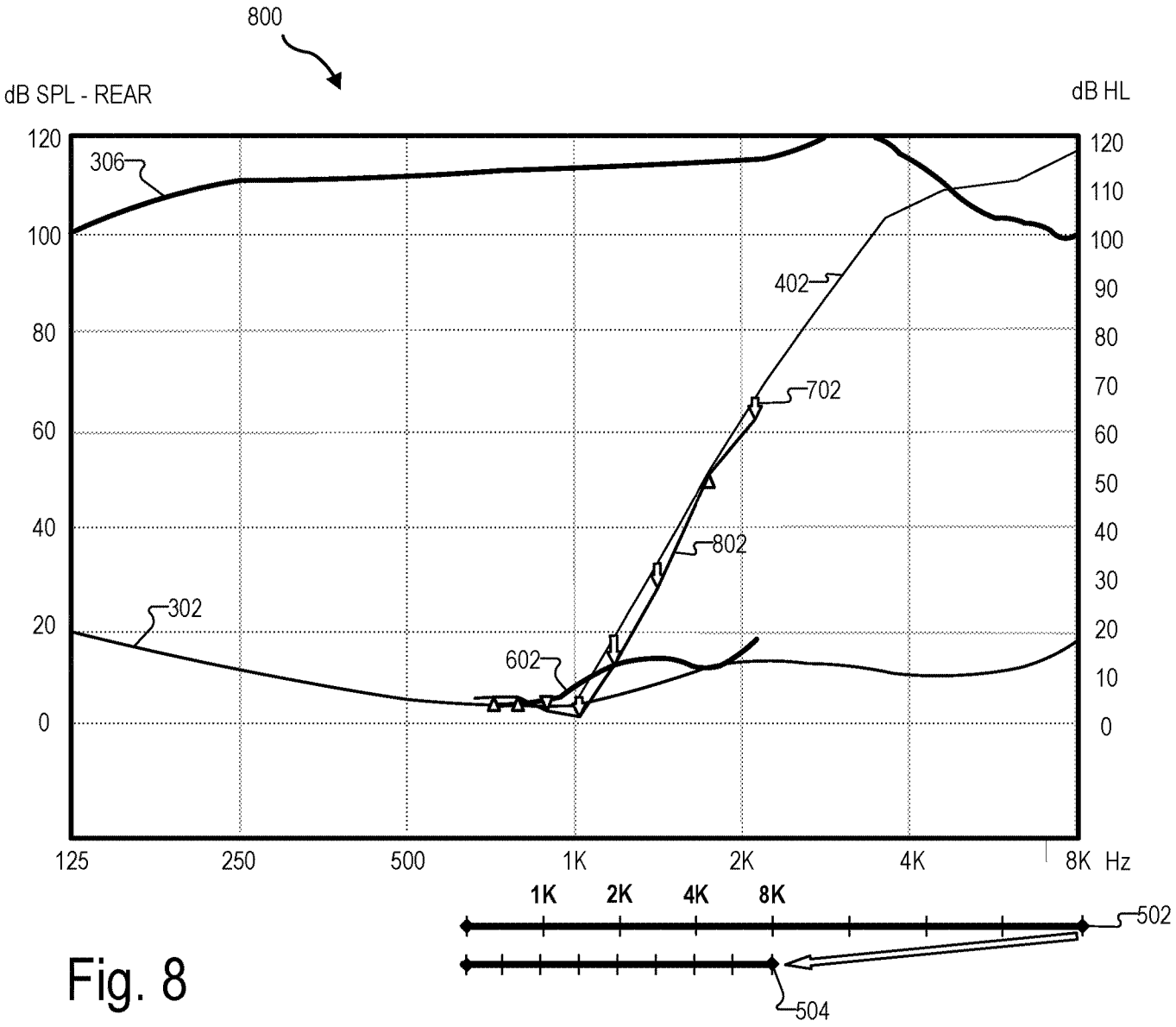
Figure 9:
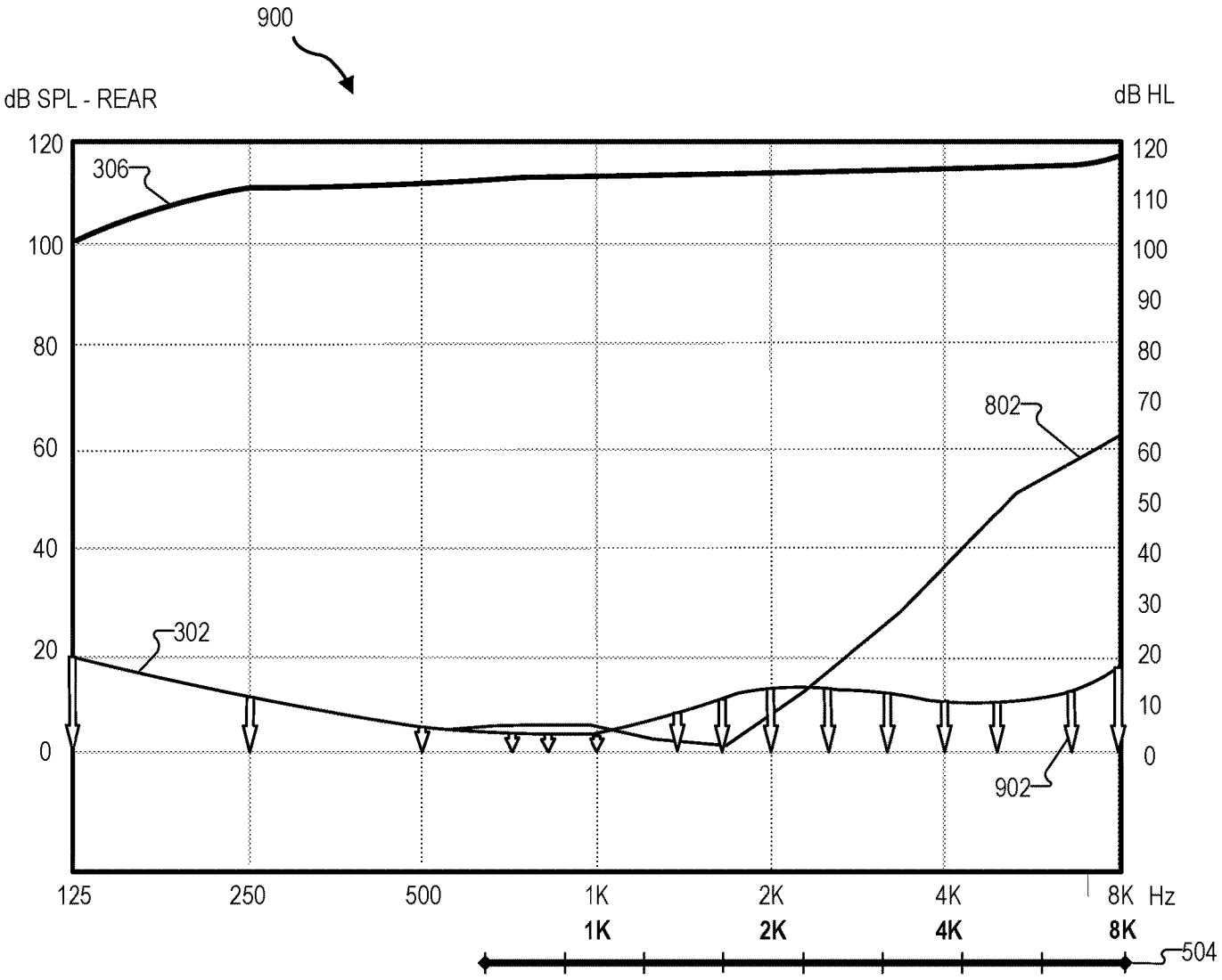

System 100 may inversely apply the frequency compression scheme to expand modified sound pressure level curve 802 from the compressed range shown in FIG. 8. This is shown in FIG. 9, which depicts a graph 900 showing a modified sound pressure level curve 802 expanded such that line graph 504 corresponding to the compressed range extends to 8 kHz. In so doing, system 100 may associate the hearing thresholds shown at the compressed range in FIG. 8 with the audio frequencies shown in FIG. 9.

Figure 10:
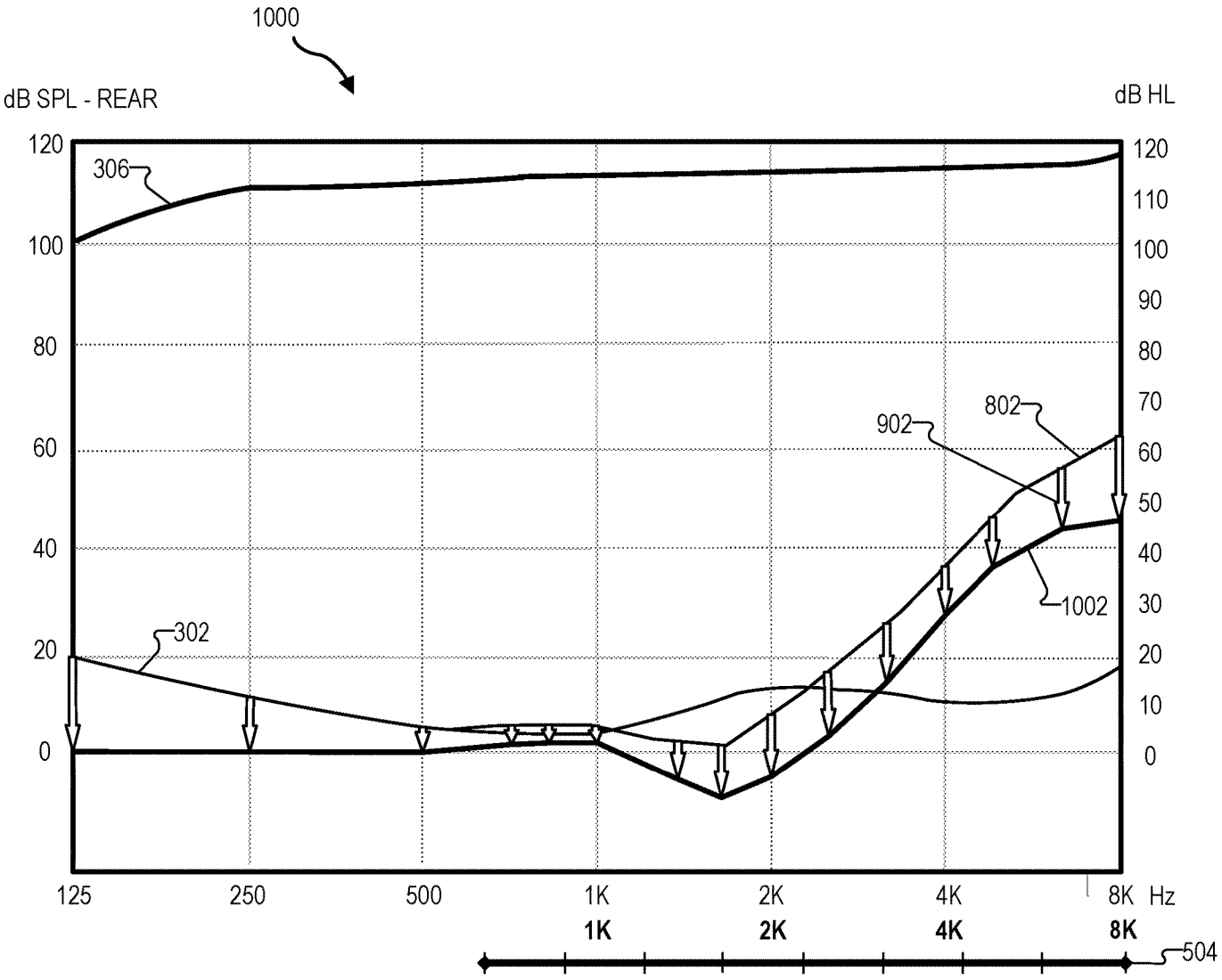

System 100 may convert the expanded modified sound pressure level curve 802 to a modified audiogram by subtracting the level difference depicted by arrow 902 and other arrows in FIG. 9 from the expanded modified sound pressure level curve 802. This is shown in FIG. 10, which depicts a graph 1000 that shows the subtraction of the level differences represented by the arrows from the expanded modified sound pressure level curve 802 to generate a modified audiogram 1002.

Modified audiogram 1002 may be used by system 100 in any suitable manner such as described herein to fit hearing device 202 to the user of hearing device 202. For example, system 100 may determine one or more target gain values for the user of hearing device 202 based on modified audiogram 1002 and an input frequency-based target gain generation model such as described herein.

Figure 11:
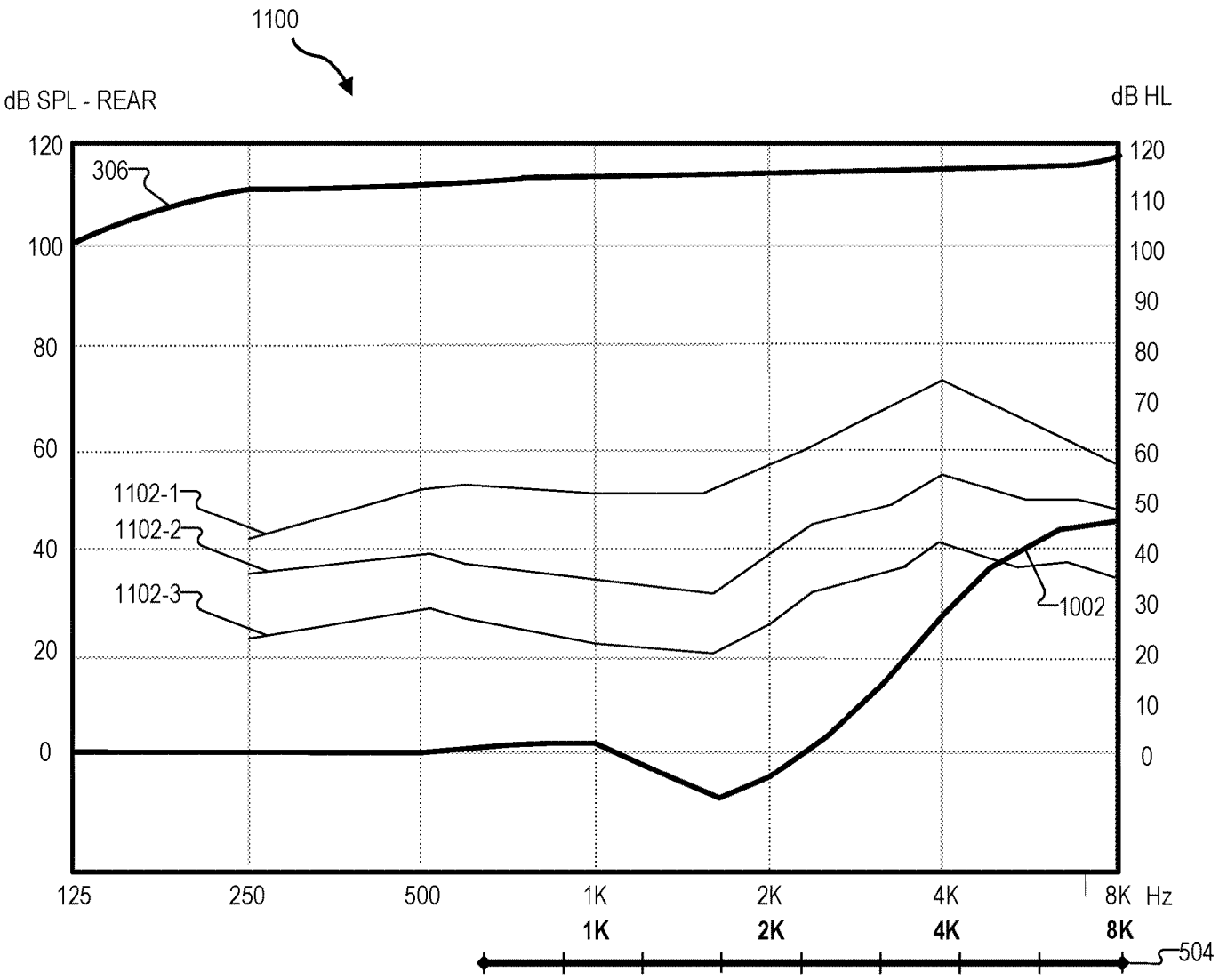

FIG. 11 depicts a graph 1100 showing a plurality of target gain curves 1102 (e.g., target gain curves 1102-1 through 1102-3) (also referred to as real ear aided response ("REAR") targets) that may be generated by system 100 based on modified audiogram 1002 and an input frequency-based target gain generation model. Target gain curves 1102 are generated based on the effects associated with frequency compression and, as a result, are different than those that would otherwise have been generated based on audiogram curve 304.

Figure 12:
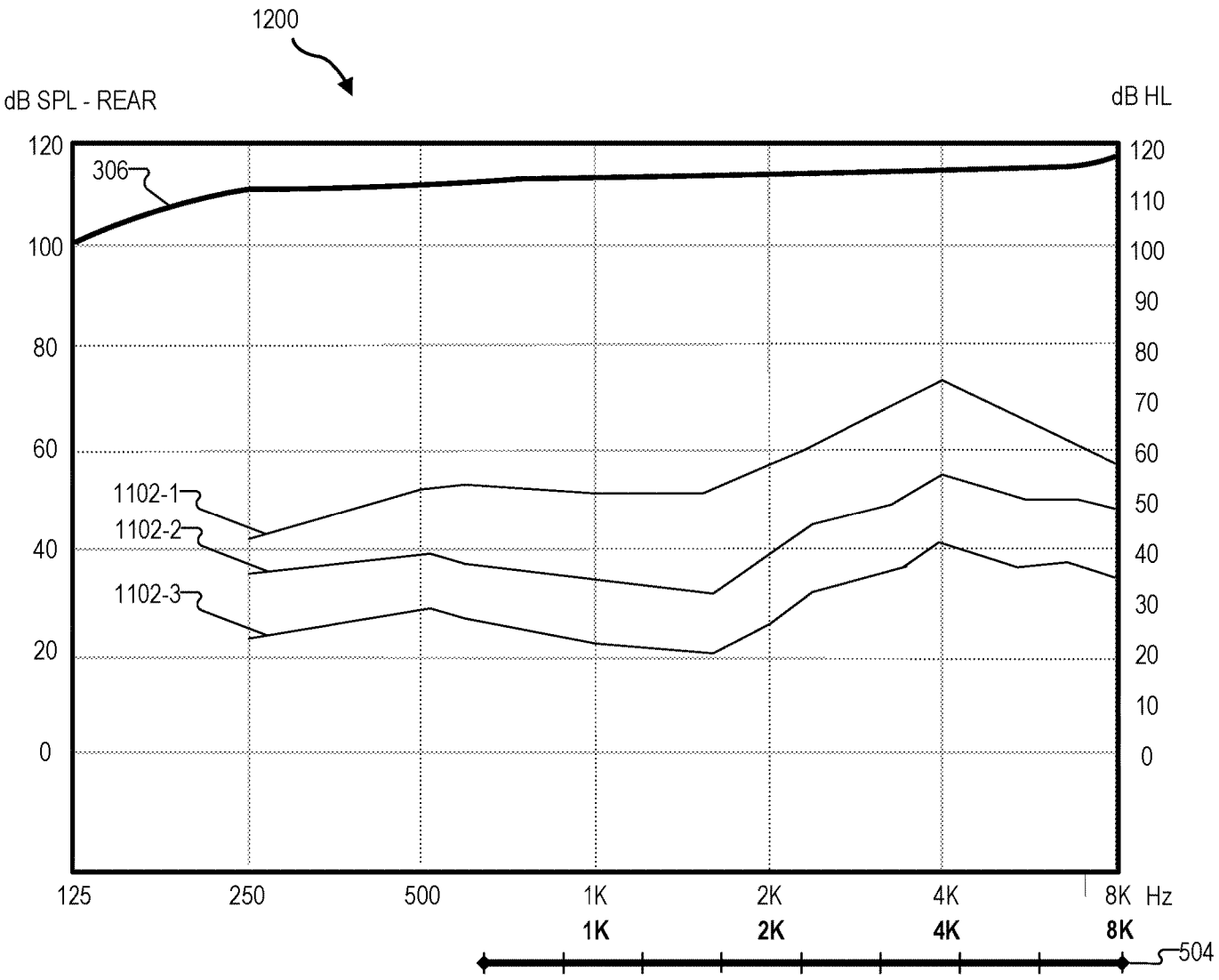

FIG. 12 depicts a graph 1200 showing how plurality of target gain curves 1102 may appear from an input frequency perspective.

Figure 13:
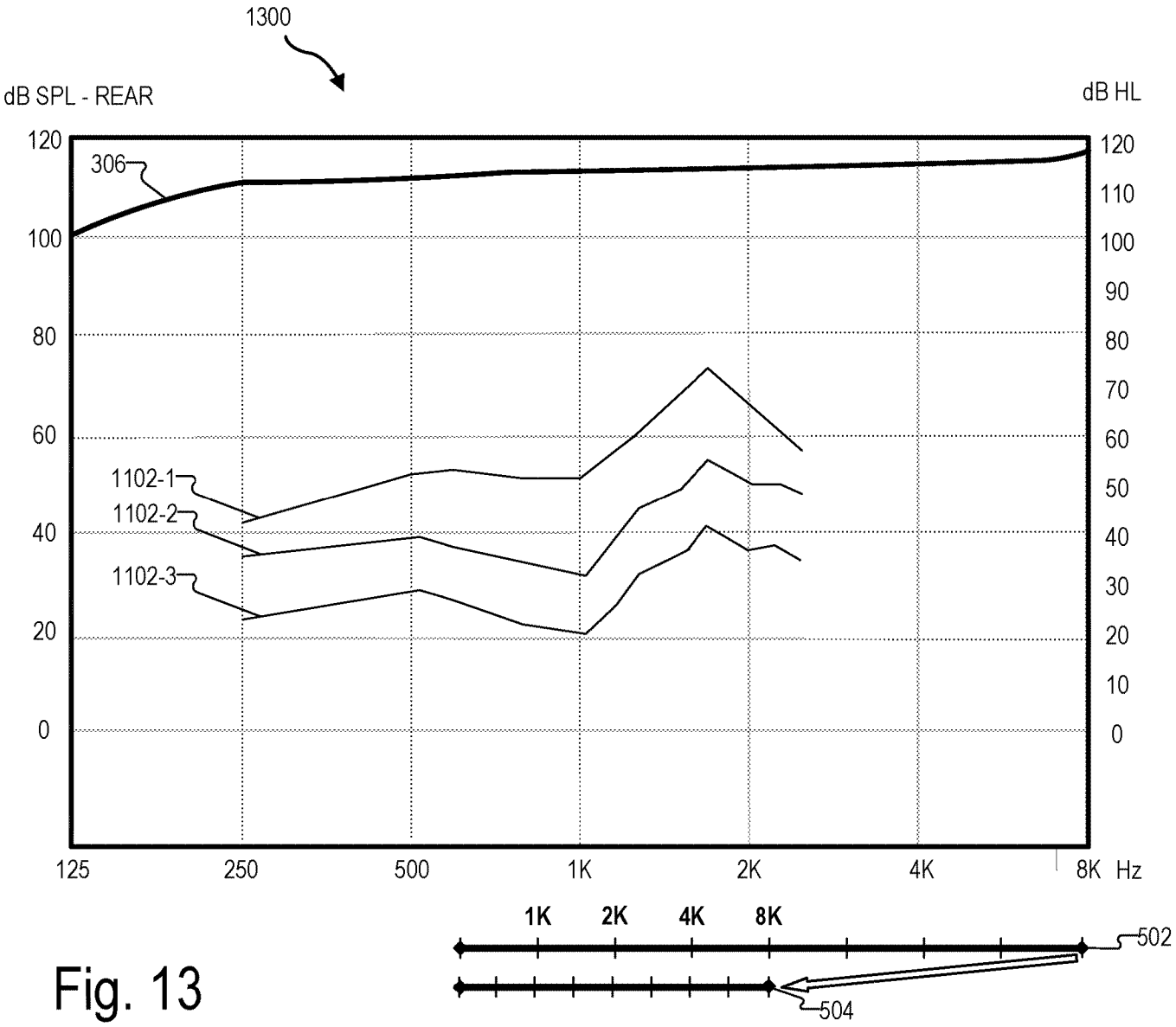

FIG. 13 depicts a graph 1300 showing how plurality of target gain curves 1102 may appear after applying frequency compression to plurality of target gain curves 1102.

Figure 14:
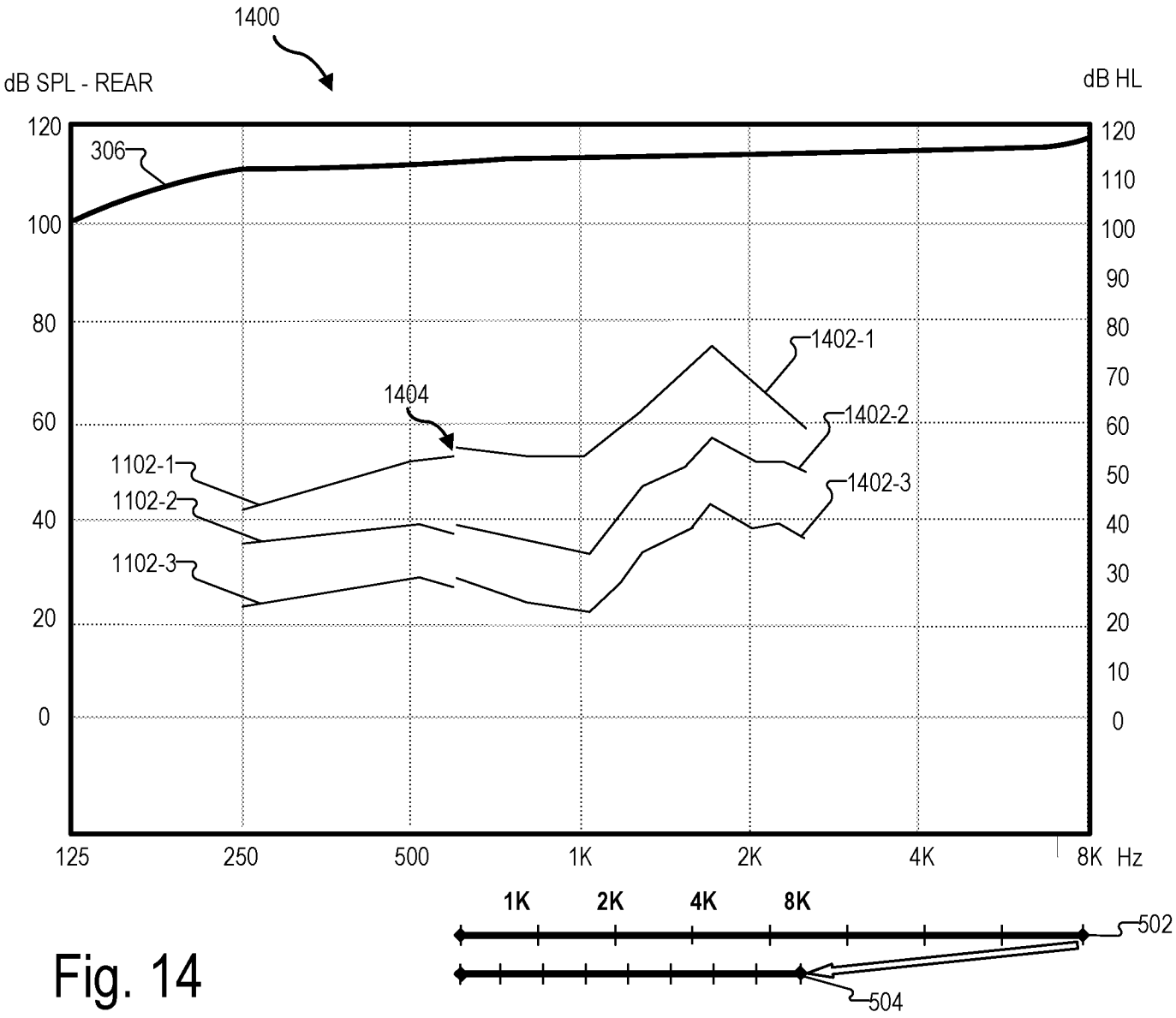

Target gain curves are typically supposed to specify the spectra for broadband signals. However, compressing a frequency range to a relatively smaller spectral target region reduces the effective bandwidth of the signals. In view of this, system 100 may be configured to increase an amplitude of a portion one or more target gain curves by a predefined amount to compensate for a change of bandwidth related energy associated with generating modified audiogram 1002. To illustrate, FIG. 14 shows a graph 1400 that depicts an increase in amplitude of portions 1402 (e.g., portions 1402-1 through 1402-3) in relation to a respective target gain curve 1102. The increase in amplitude is depicted in FIG. 14 by, for example, a gap 1404 shown between target gain curve 1102-1 and portion 1402-1. Similar gaps are depicted with respect to portion 1402-2 and portion 1402-3. The predefined amount may be any suitable amount as may serve a particular implementation. For example, in certain implementations, the predefined amount may be approximately 3 dB.

Figure 15:
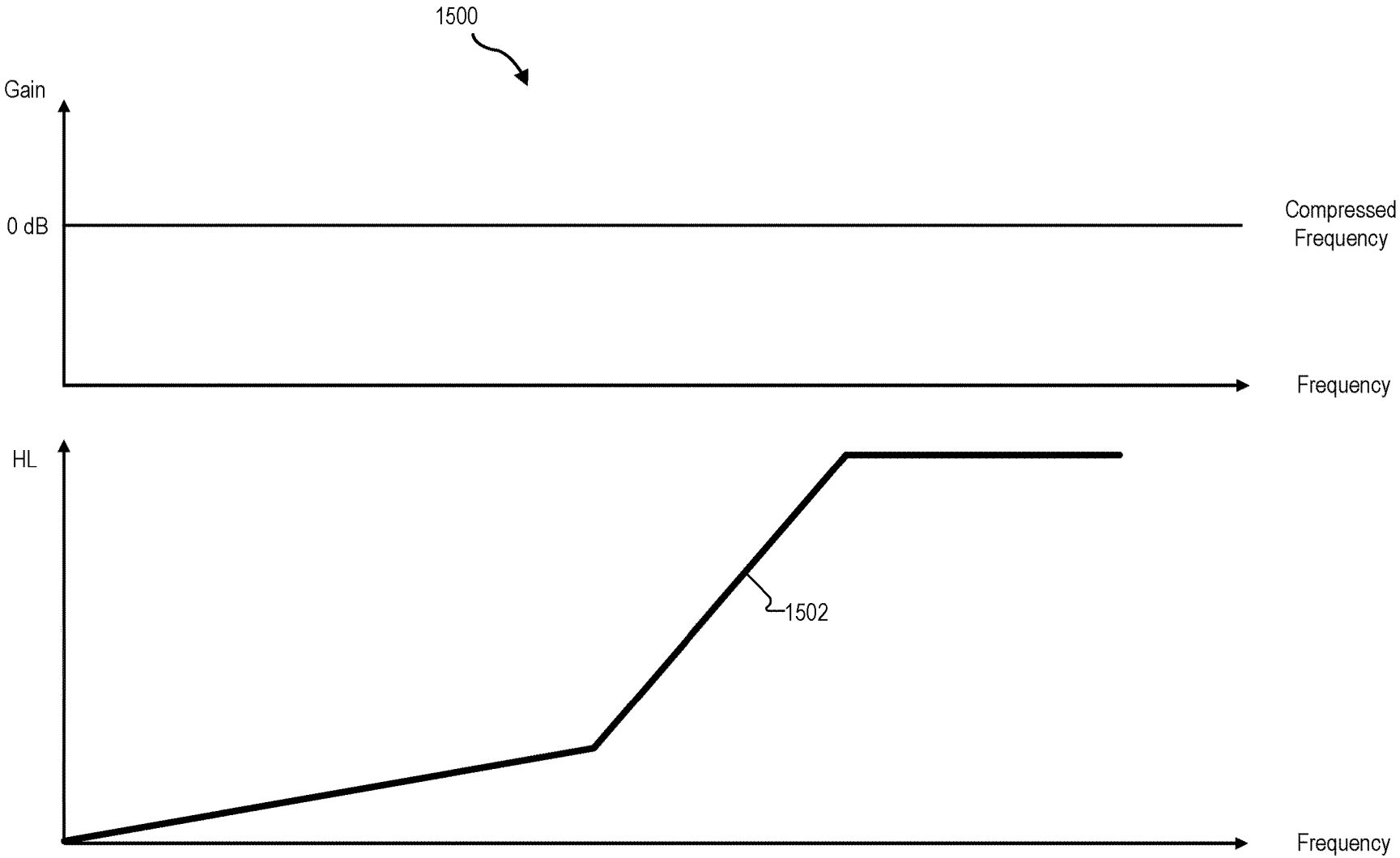
FIGS. 15-19 illustrate exemplary graphs that depict how a modified audiogram may be generated based on application of an adaptive frequency compression scheme according to principles described herein.

FIGS. 15-19 depict exemplary graphs that depict generation of a modified audiogram in instances where an adaptive frequency compression scheme is implemented. FIG. 15 depicts graphs 1500 showing an audiogram 1502 of a user of hearing device 202. Audiogram 1502 is depicted in FIG. 15 in a lower graph that plots frequency on the horizontal axis and hearing level ("HL") on the vertical axis. An upper graph shown in FIG. 15 plots frequency on the horizontal axis and gain on the vertical axis. The upper graph shown in FIG. 15 further depicts a horizontal compressed frequency axis at 0 dB that may represent a frequency compressible reference level. The upper and lower graphs shown in FIGS. 15-18 are provided to illustrate a relationship between adaptive frequency compression illustrated in the upper graph and audiogram 1502 illustrated in the lower graph.

Figure 16:
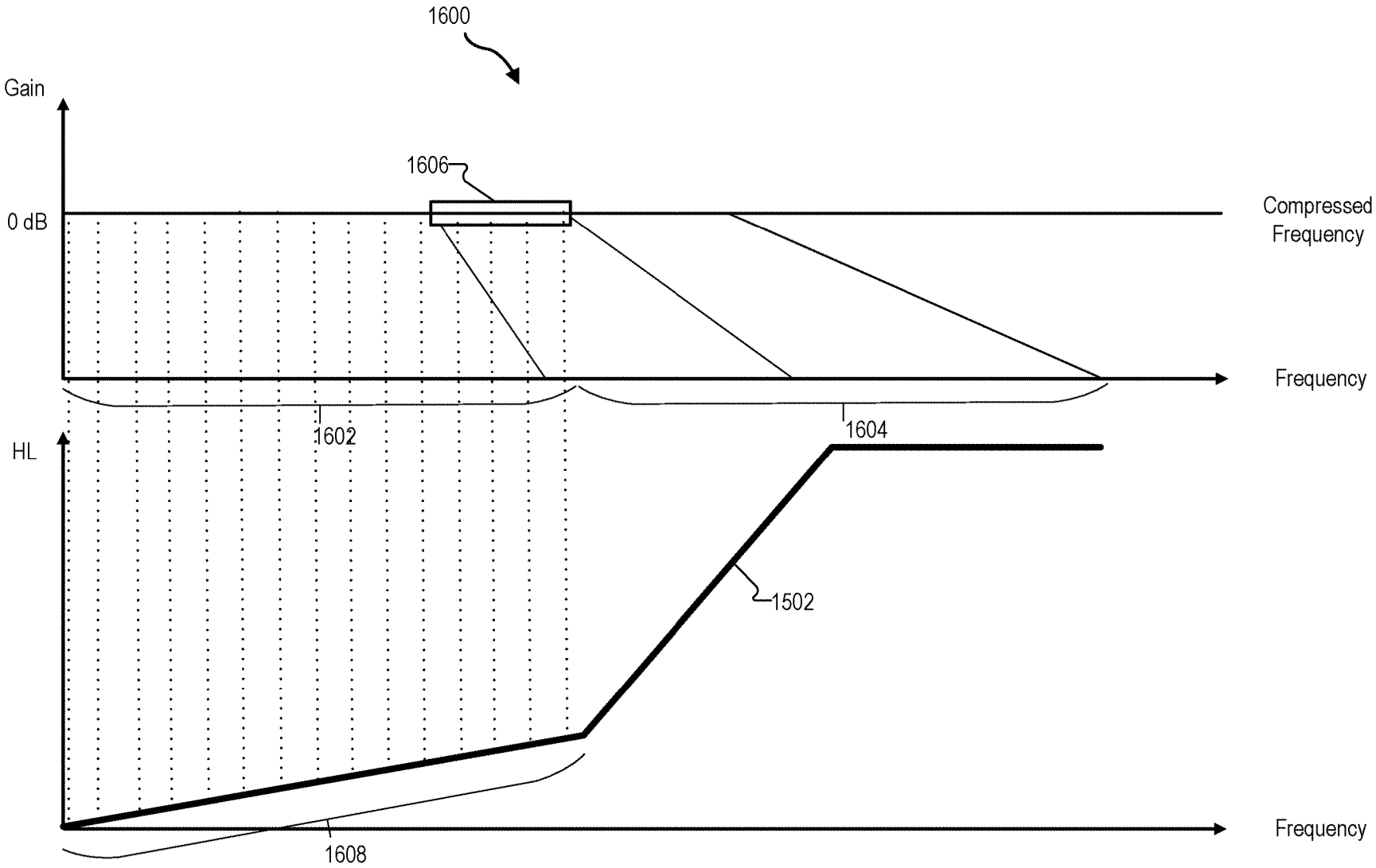

The upper graph shown in graphs 1600 of FIG. 16 depicts a set of frequencies 1602 that is not subject to frequency compression, a set of frequencies 1604 that is subject to frequency compression, and an adaptive area 1606 of frequencies that may or may not compressed depending on an amplitude of incoming sound. Because set of frequencies 1602 is not subject to frequency compression, the dotted lines depicted in FIG. 16 indicate that an original portion 1608 of audiogram 1502 may be used as part of a modified audiogram.

Figure 17:
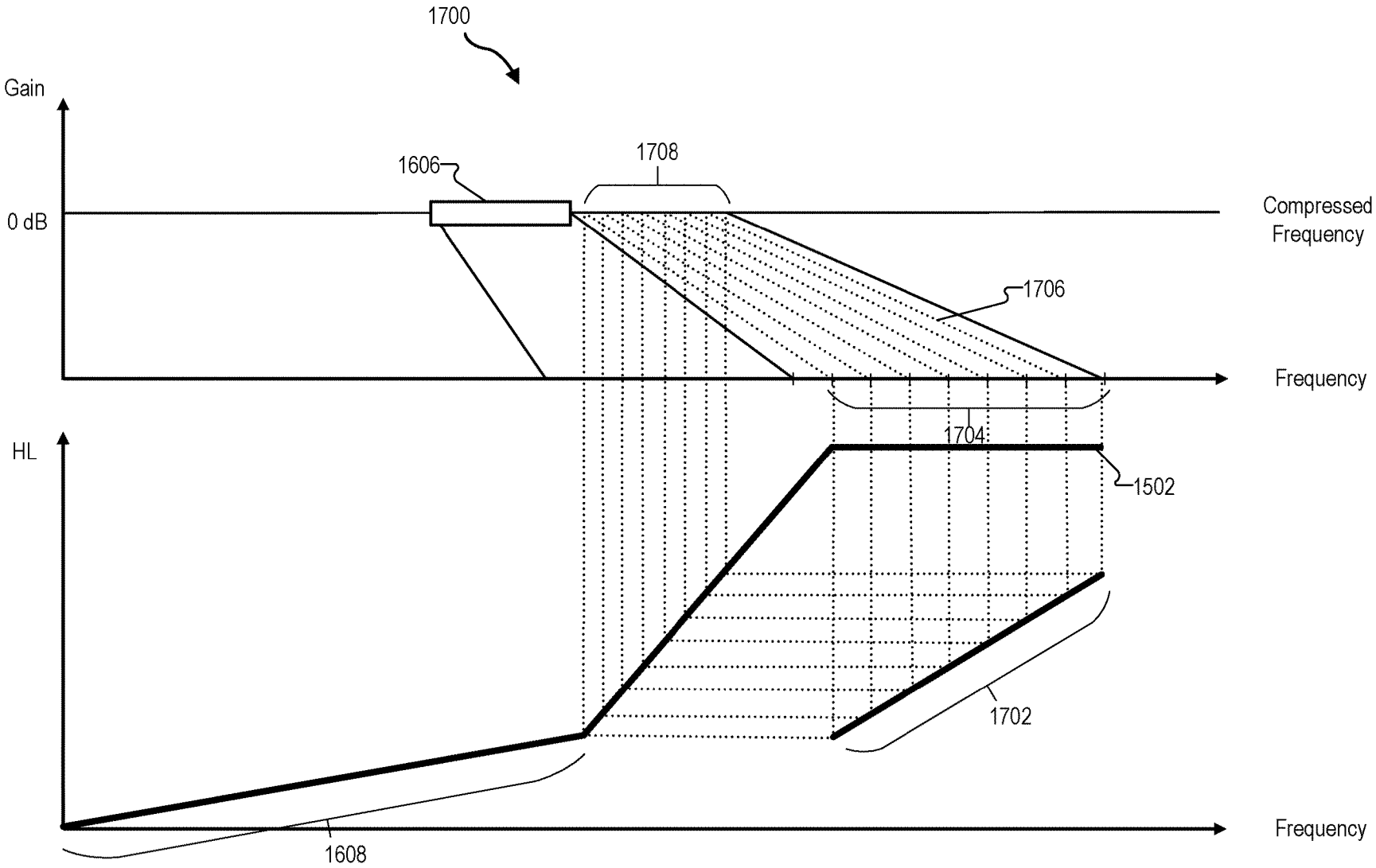

Graphs 1700 shown in FIG. 17 depict how a portion 1702 of a modified audiogram may be determined. As shown in FIG. 17, a set of frequencies 1704 outside of adaptive area 1606 may be mapped to a relatively lower set of frequencies along a compressed frequency axis at 0 dB. Dotted line 1706 and other dotted lines depicted in FIG. 17 are intended to depict one or more mappings that may be used to determine portion 1702. The dotted lines depict a first mapping from set of frequencies 1704 to a set of frequencies 1708 along the compressed frequency axis at 0 dB. The dotted lines further depict a second mapping from set of frequencies 1708 to audiogram 1502. The dotted lines further depict a third mapping from the hearing thresholds where the dotted lines intersect audiogram 1502 to corresponding frequencies from set of frequencies 1704, which indicates portion 1702 of the modified audiogram. Portion 1702 may represent a hearing level transformation outside of adaptive area 1606.

Figure 18:
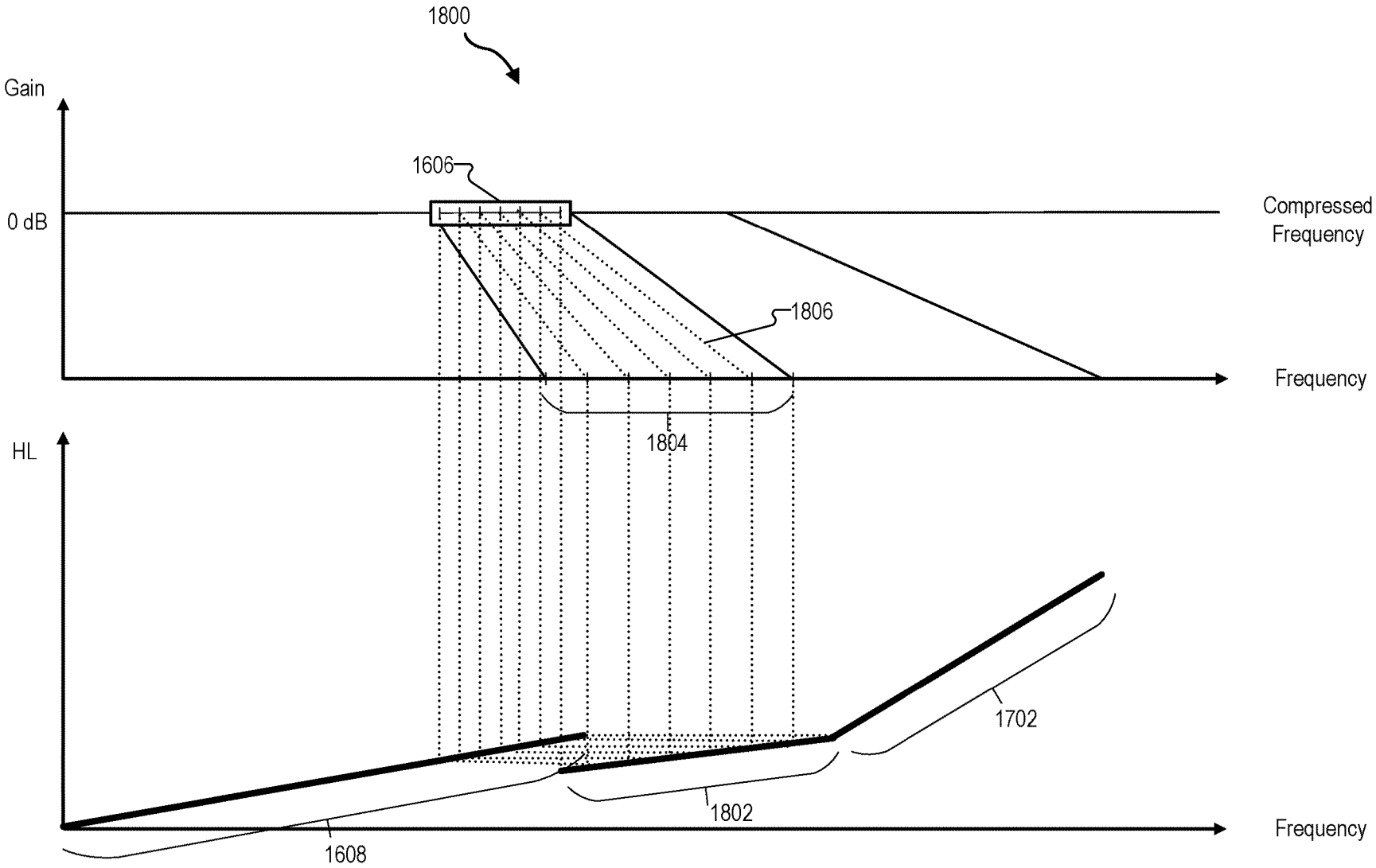

Graphs 1800 depicted in FIG. 18 depict how a portion 1802 of a modified audiogram may be determined. As shown in FIG. 18, a set of frequencies 1804 may be transposed to a relatively lower set of frequencies inside of adaptive area 1606 along the compressed frequency axis at 0 dB. Dotted line 1806 and other dotted lines depicted in FIG. 18 are intended to depict one or more mappings that may be used to determine portion 1802. The dotted lines in FIG. 18 depict a first mapping from set of frequencies 1804 to adaptive area 1606 along the compressed frequency axis at 0 dB. The dotted lines in FIG. 18 further depict a second mapping from adaptive area 1606 to portion 1608 of audiogram 1502. The dotted lines in FIG. 18 further depict a third mapping from portion 1608. The hearing thresholds where the dotted lines intersect portion 1608 may then be mapped to corresponding frequencies in set of frequencies 1804, which indicates portion 1802 of the modified audiogram. Portion 1802 may represent a hearing level transformation inside of adaptive area 1606.

Figure 19:
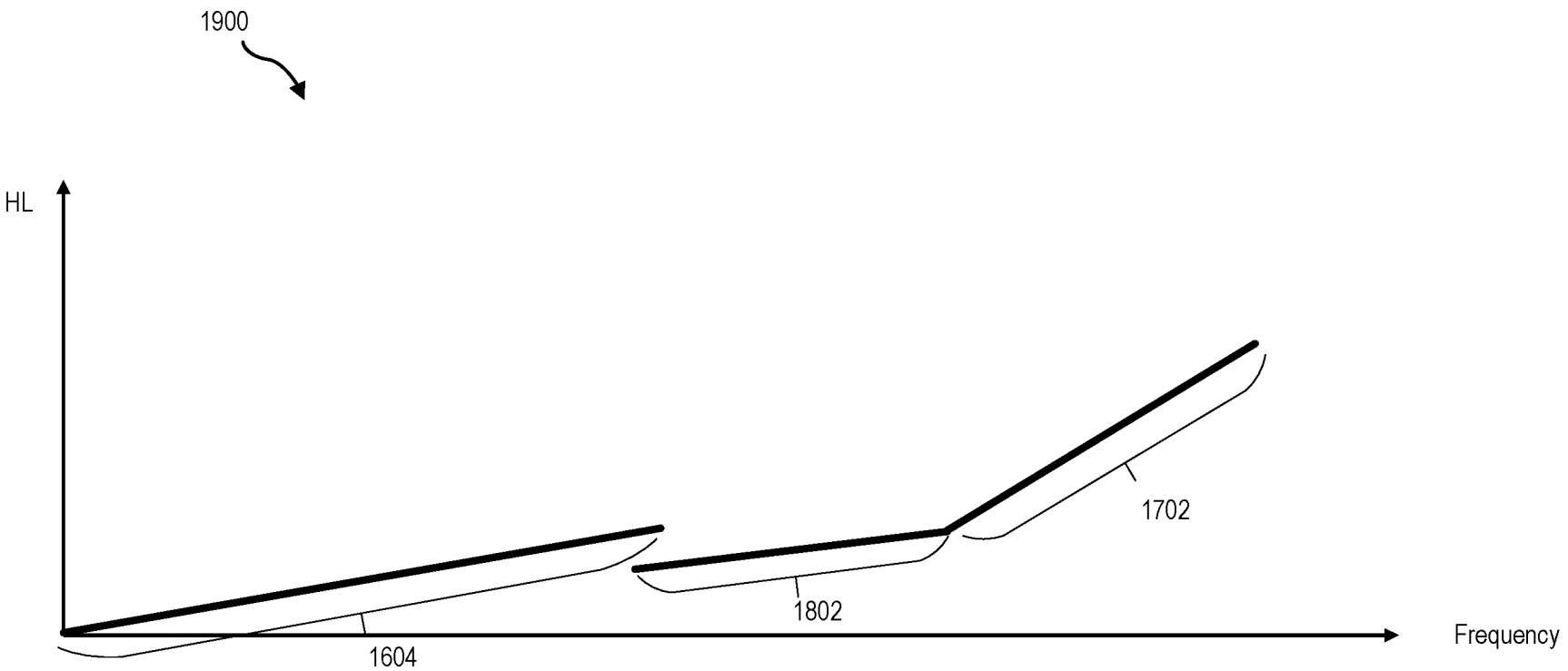

FIG. 19 depicts a graph 1900 showing a modified audiogram, which may be considered as the combination of portion 1608, portion 1702, and portion 1802.

In certain alternative examples, a process similar to that depicted in FIGS. 15-19 may be performed by system 100 in examples where an audiogram of a user of hearing device 202 may comprise both a discomfort threshold curve and an audibility threshold curve.

In certain examples, system 100 may be configured to facilitate optimizing an amount of frequency lowering to be applied by way of frequency lowering schemes such as those described herein. As used herein, to "optimize" an amount of frequency lowering may generally mean determining the least amount of frequency lowering needed to bring one or more target prescriptions (e.g., target gain prescriptions) substantially within the performance limits of hearing device 202. In certain examples, system 100 may facilitate such an optimization with respect to a modified audiogram such as described herein. System 100 may facilitate optimizing an amount of frequency lowering in any suitable manner as may serve a particular implementation. For example, system 100 may provide one or more graphical user interfaces for display on a display device to facilitate optimizing an amount of frequency lowering to be applied by way of hearing device 202. Such graphical user interfaces may facilitate the user incrementally changing an amount of frequency lowering to determine a suitable amount of frequency lowering to be applied by way of a frequency lowering scheme. In certain examples, it may be desirable to find the smallest amount of frequency lowering that may be applied and still result in target gain curves being within the performance limit of hearing device 202.

Figure 20:
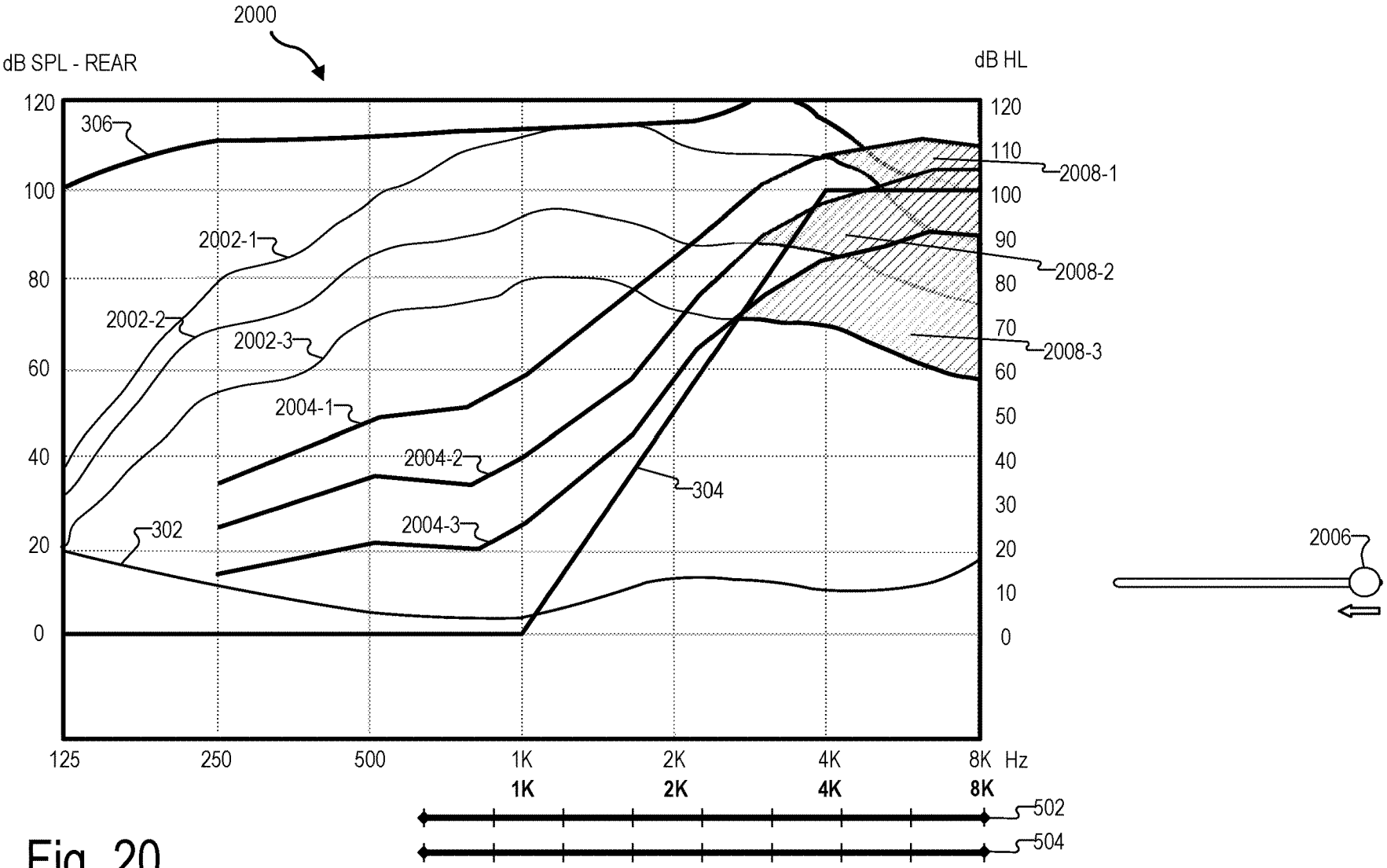
FIGS. 20-23 illustrate exemplary user interface views that may be provided for display by way of a display device to facilitate optimizing an amount of frequency lowering that may be applied according to principles described herein.

To illustrate an example, FIGS. 20-23 depict exemplary graphical user interface views that may be provided for display by system 100 to facilitate optimizing an amount of frequency lowering. FIG. 20 shows a graphical user interface view 2000 that depicts a graph including maximum hearing device output curves 2002 (e.g., maximum hearing device output curves 2002-1 through 2002-3) and target gain curves 2004 (e.g., target gain curves 2004-1 through 2004-3). Maximum hearing device output curves 2002 may each depict a maximum output for hearing device 202 at a particular sound signal level. For example, maximum hearing device output curve 2002-1 may define a maximum hearing device output for an 80 dB sound signal, maximum hearing device output curve 2002-2 may define a maximum hearing device output for a 65 dB sound signal, and maximum hearing device output curve 2002-3 may define a maximum hearing device output for a 50 dB sound signal. Similarly, target gain curves 2004 may each depict a target gain prescription at a particular sound signal level. For example, target gain curve 2004-1 may correspond a REAR target for an 80 dB sound signal, target gain curve 2004-2 may correspond to a REAR target for a 65 dB sound signal, and target gain curve 2004-3 may correspond to a REAR target for a 50 dB sound signal.

FIG. 20 further depicts a slider 2006 that a user may interact with to either increase or decrease an amount of applied frequency compression. Although slider 2006 is depicted in the example shown in FIG. 20, it is understood that any other suitable type of user input mechanism (e.g., touch inputs, buttons, etc.) may be provided in alternative implementations. In the example shown in FIG. 20 slider 2006 is provided at a right side of a slider bar because no frequency compression has been applied in FIG. 20.

As shown in FIG. 20, with no frequency compression applied, the amount of gain needed for certain portions of target gain curves 2004 exceeds maximum hearing device output curves 2002. This is represented in FIG. 20 by shaded regions 2008-1 through 2008-3. In view of this, a user may move slider 2006 to the left to apply frequency compression.

Figure 21:
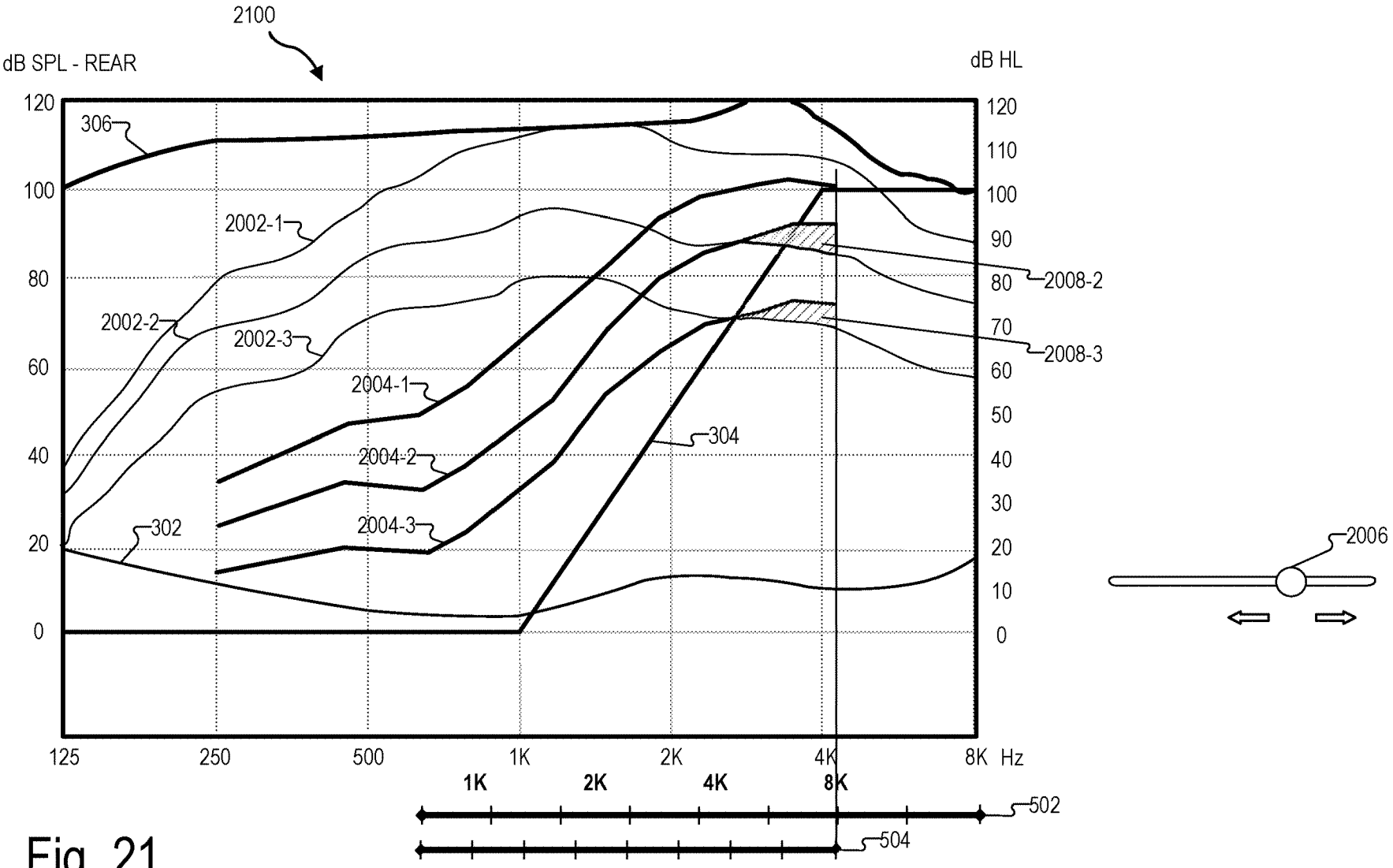

FIG. 21 depicts a graphical user interface view 2100 where slider 2006 has been moved to the left to apply an amount of frequency compression. As a result, FIG. 21 shows that target gain curve 2004-1 is now lower than maximum hearing device output curve 2002-1. However, the amount of gain needed for at least portions of target gain curves 2004-2 and 2004-3 still exceeds maximum hearing device output curves 2002-2 and 2002-3 in shaded regions 2008-2 and 2008-3. In view of this, the user may move slider 2006 further to the left to apply more frequency compression.

Figure 22:
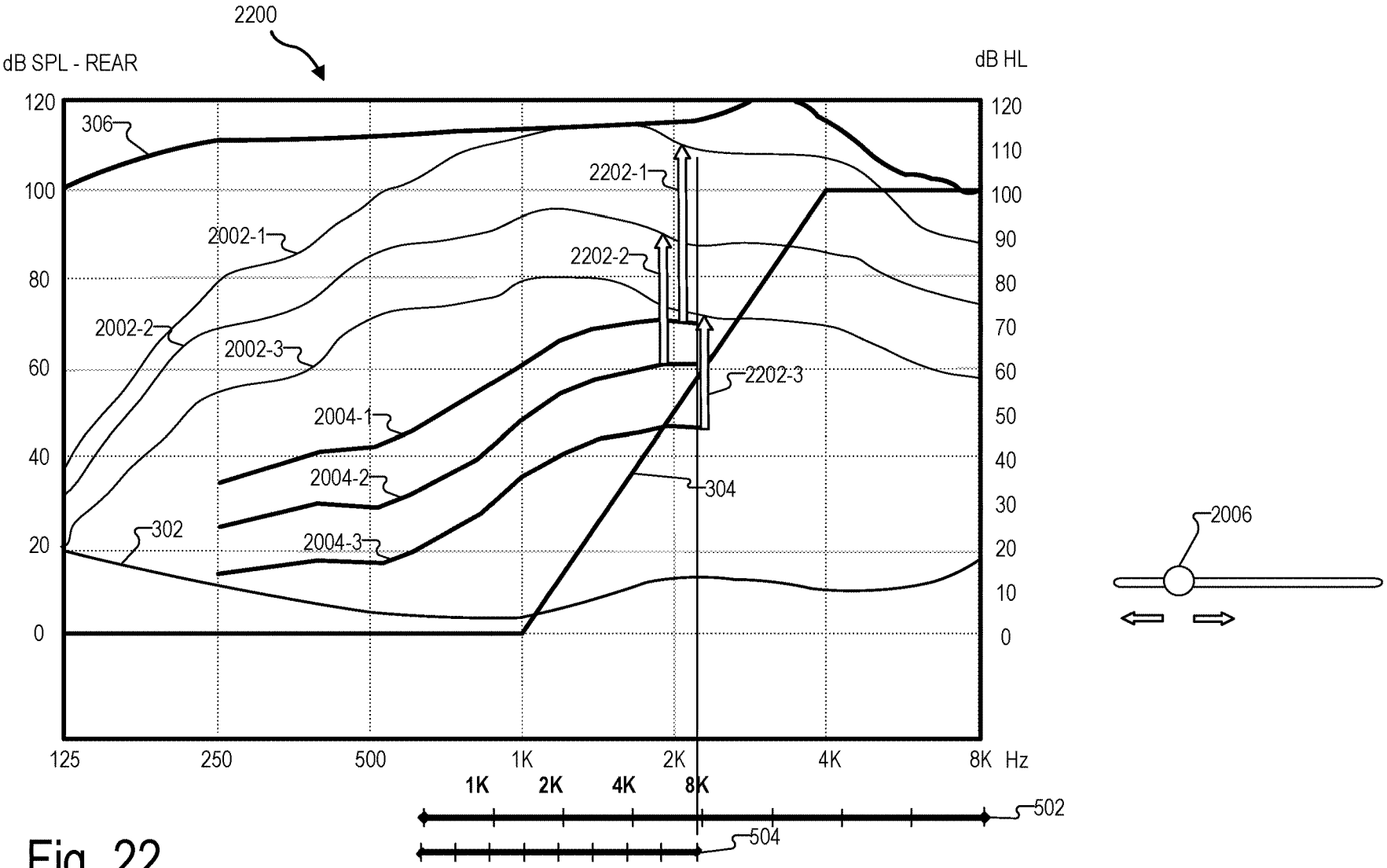
Figure 23:
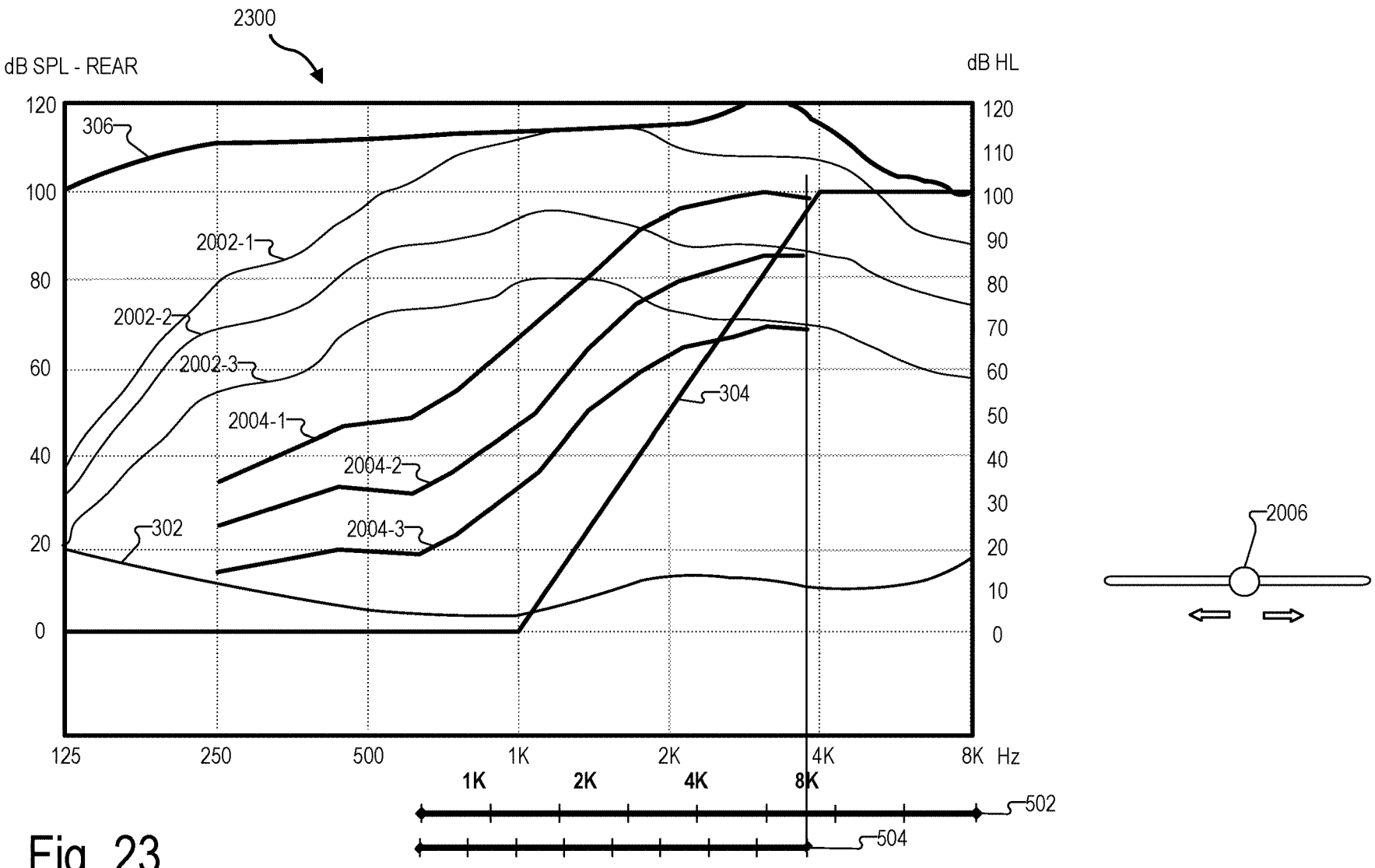

FIG. 22 depicts a graphical user interface view 2200 where too much frequency compression has been applied. As shown in FIG. 22, each of target gain curves 2004 are now within maximum hearing device output curves 2002. However, as illustrated by arrows 2202 (e.g., arrows 2202-1 through 2202-3), too much frequency compression has been applied in FIG. 22 resulting in unnecessarily large output reserves.

From the slider position depicted in FIG. 22, the user may move slider 2006 to the right until each of target gain curves 2004 is just below a respective maximum hearing device output curve 2002. An example of this is shown in a graphical user interface view 2300 depicted in FIG. 23, which shows a rightmost end of target gain curve 2004-1 being below maximum hearing device output curve 2002-1, a rightmost end of target gain curve 2004-2 being just below maximum hearing device output curve 2002-2, and a rightmost end of target gain curve 2004-3 being just below maximum hearing device output curve 2002-3. The positions of target gain curves 2004 depicted in FIG. 22 may represent the smallest amount of frequency lowering that may be applied and still result in target gain curves 2004 being within the performance limit of hearing device 202. In so doing, it may be possible to optimize an amount of frequency lowering that may be applied by way of hearing device 202 and minimize reduction in sound quality that may occur due to overly aggressive frequency lowering.

In certain alternative examples, system 100 may be configured to automatically determine an optimal amount of frequency lowering to be applied according to principles described herein. As used herein, the expression "automatically" means that an operation (e.g., determining an optimal amount of frequency lowering) or series of operations are performed without requiring further input from a user. For example, in certain implementations, system 100 may automatically determine an optimal amount of frequency lowering without requiring the user to provide an input by way of slider 2006 or any other input.

Figure 24:
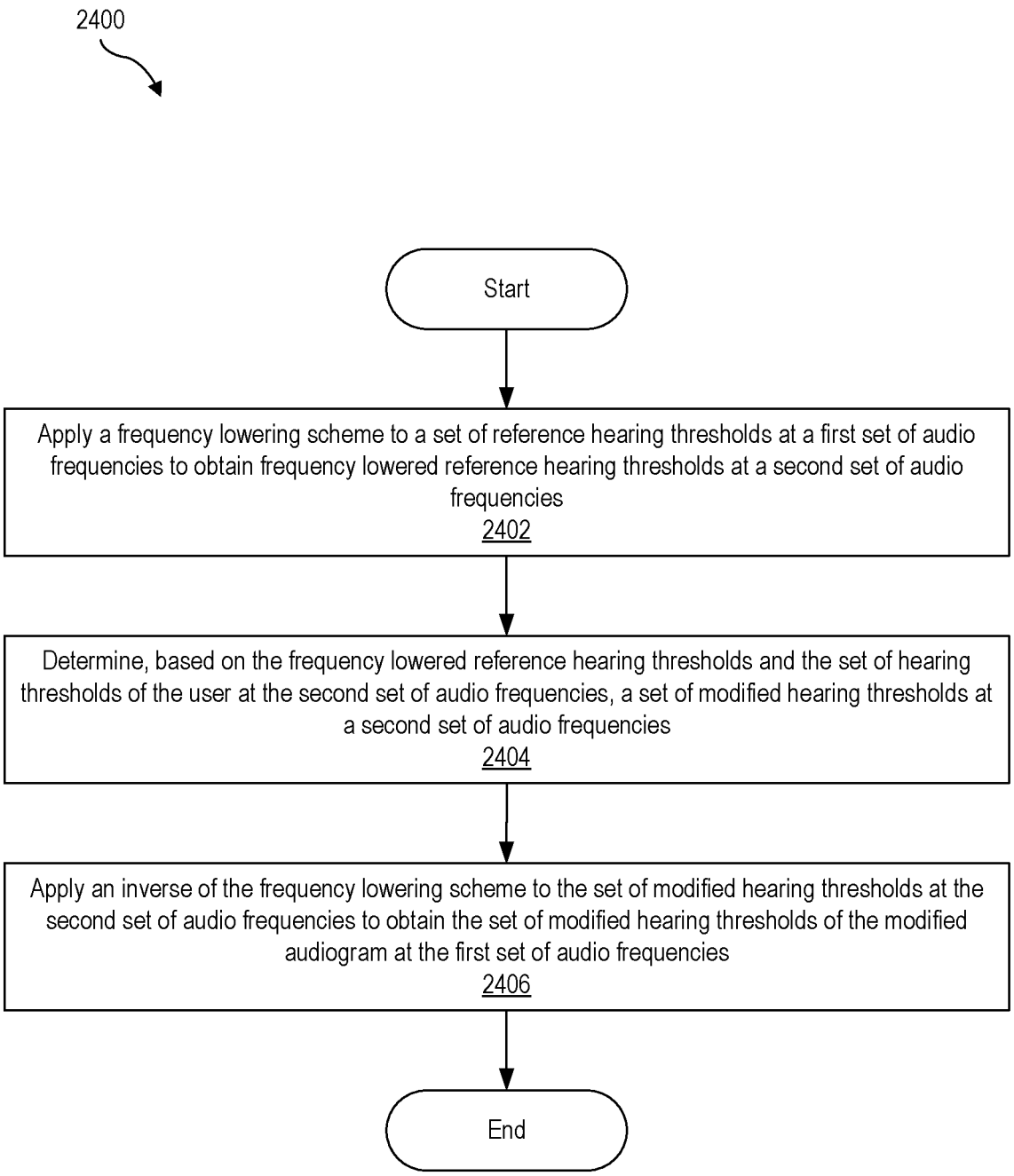
FIGS. 24-25 illustrate exemplary methods according to principles described herein.

FIG. 24 illustrates an exemplary method 2400 for generating a modified audiogram according to principles described herein. As described herein, such a modified audiogram may be based on a frequency lowering scheme that maps at least some audio frequencies included in a first set of audio frequencies to relatively lower audio frequencies to form a second set of audio frequencies. In addition, the modified audiogram may indicate a set of modified hearing thresholds of the user at the first set of audio frequencies, which set of modified hearing thresholds is based on a set of hearing thresholds for the user at the second set of audio frequencies. While FIG. 24 illustrates exemplary operations according to one embodiment, other embodiments may omit, add to, reorder, and/or modify any of the operations shown in FIG. 24. One or more of the operations shown in FIG. 24 may be performed by a hearing device such as hearing device 202 a computing device such as processor 104, any components included therein, and/or any combination or implementation thereof.

At operation 2402, a processor such as processor 104 may apply a frequency lowering scheme to a set of reference hearing thresholds at the first set of audio frequencies to obtain frequency lowered reference hearing thresholds at a second set of audio frequencies. Operation 2402 may be performed in any of the ways described herein.

At operation 2404, the processor may determine, based on the frequency lowered reference hearing thresholds and the set of hearing thresholds of the user at the second set of audio frequencies, the set of modified hearing thresholds at the second set of audio frequencies. Operation 2404 may be performed in any of the ways described herein.

At operation 2406, the processor may apply an inverse of the frequency lowering scheme to the set of modified hearing thresholds at the second set of audio frequencies to obtain the set of modified hearing thresholds for the modified audiogram at the first set of audio frequencies. Operation 2406 may be performed in any of the ways described herein.

Figure 25:
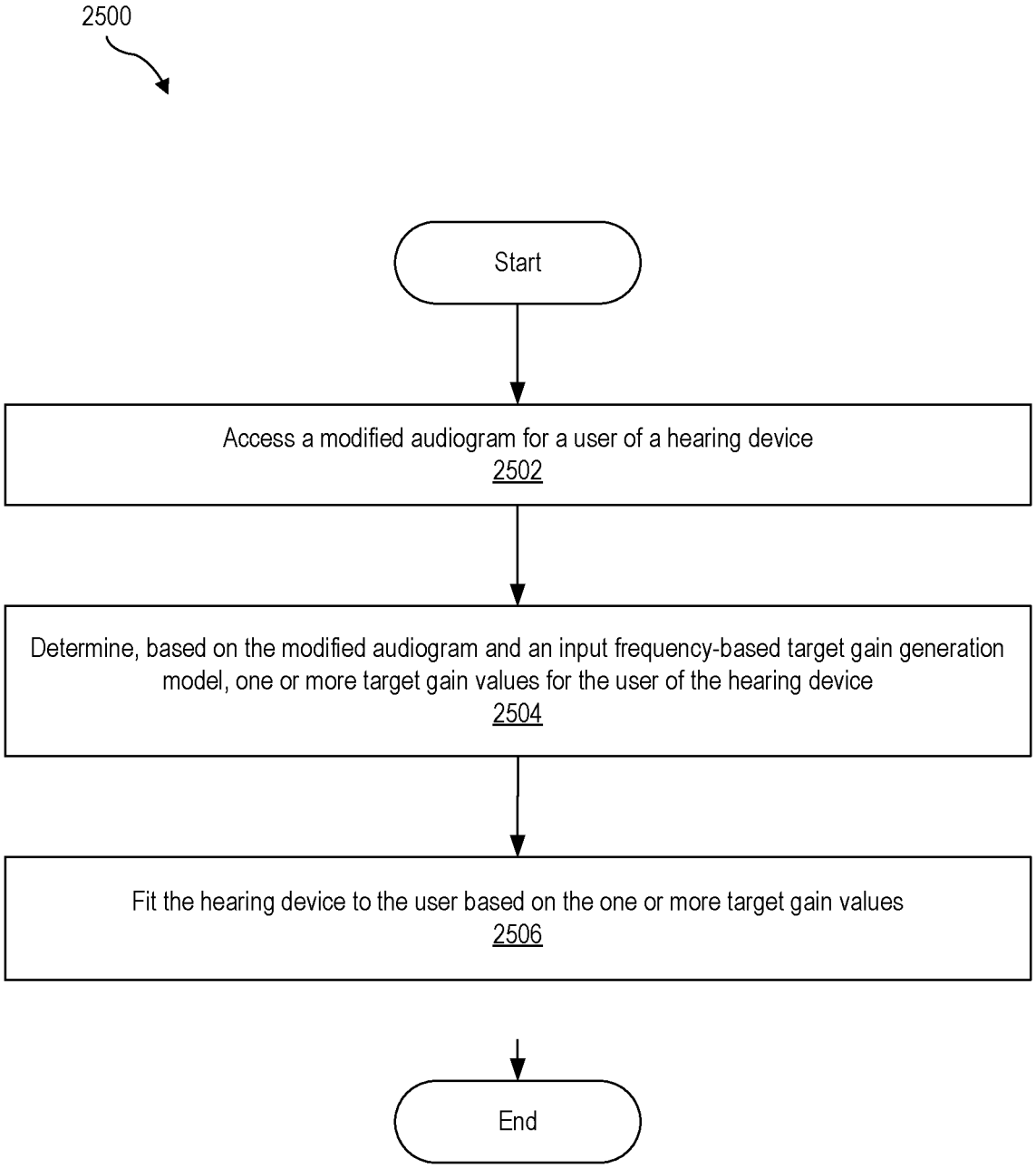

FIG. 25 illustrates an exemplary method 2500 for implementing a modified audiogram according to principles described herein. While FIG. 25 illustrates exemplary operations according to one embodiment, other embodiments may omit, add to, reorder, and/or modify any of the operations shown in FIG. 25. One or more of the operations shown in FIG. 25 may be performed by a hearing device such as hearing device 202 a computing device such as processor 104, any components included therein, and/or any combination or implementation thereof.

At operation 2502, a processor such as processor 104 may access a modified audiogram for a user of a hearing device. Operation 2502 may be performed in any of the ways described herein.

At operation 2504, the processor may determine, based on the modified audiogram and an input frequency-based target gain generation model, one or more target gain values for the user of the hearing device. Operation 2504 may be performed in any of the ways described herein.

At operation 2506, the processor may fit the hearing device to the user based on the one or more target gain values. Operation 2506 may be performed in any of the ways described herein.

In some examples, a non-transitory computer-readable medium storing computer-readable instructions may be provided in accordance with the principles described herein. The instructions, when executed by a processor of a computing device, may direct the processor and/or computing device to perform one or more operations, including one or more of the operations described herein. Such instructions may be stored and/or transmitted using any of a variety of known computer-readable media.

A non-transitory computer-readable medium as referred to herein may include any non-transitory storage medium that participates in providing data (e.g., instructions) that may be read and/or executed by a computing device (e.g., by a processor of a computing device). For example, a non-transitory computer-readable medium may include, but is not limited to, any combination of non-volatile storage media and/or volatile storage media. Exemplary non-volatile storage media include, but are not limited to, read-only memory, flash memory, a solid-state drive, a magnetic storage device (e.g., a hard disk, a floppy disk, magnetic tape, etc.), ferroelectric random-access memory ("RAM"), and an optical disc (e.g., a compact disc, a digital video disc, a Blu-ray disc, etc.). Exemplary volatile storage media include, but are not limited to, RAM (e.g., dynamic RAM).

Figure 26:
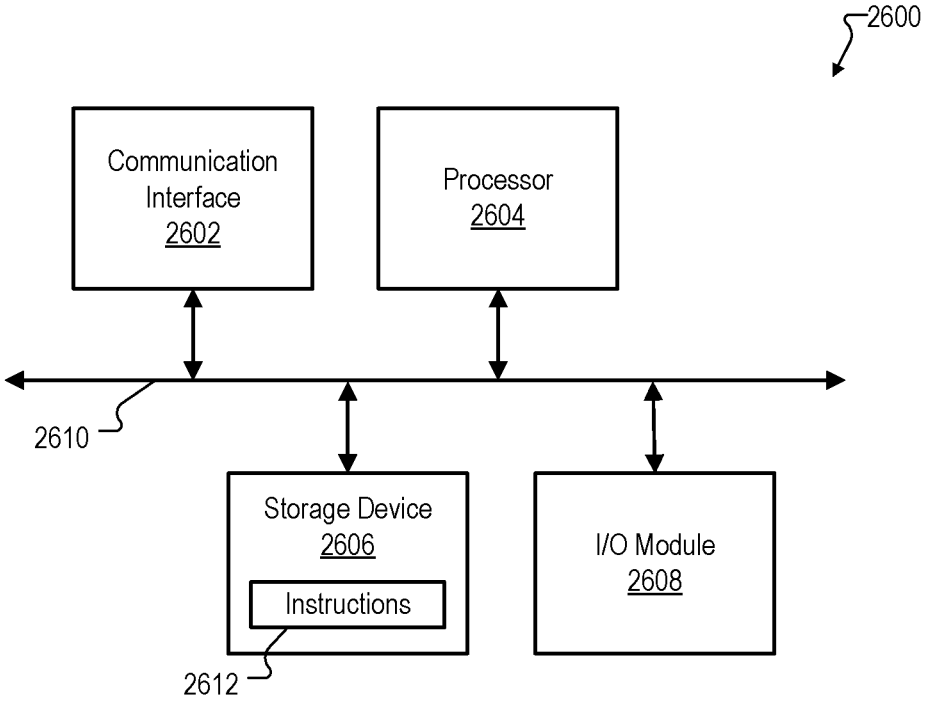
FIG. 26 illustrates an exemplary computing device according to principles described herein.

FIG. 26 illustrates an exemplary computing device 2600 that may be specifically configured to perform one or more of the processes described herein. As shown in FIG. 26, computing device 2600 may include a communication interface 2602, a processor 2604, a storage device 2606, and an input/output ("I/O") module 2608 communicatively connected one to another via a communication infrastructure 2610. While an exemplary computing device 2600 is shown in FIG. 26, the components illustrated in FIG. 26 are not intended to be limiting. Additional or alternative components may be used in other embodiments. Components of computing device 2600 shown in FIG. 26 will now be described in additional detail.

Communication interface 2602 may be configured to communicate with one or more computing devices. Examples of communication interface 2602 include, without limitation, a wired network interface (such as a network interface card), a wireless network interface (such as a wireless network interface card), a modem, an audio/video connection, and any other suitable interface.

Processor 2604 generally represents any type or form of processing unit capable of processing data and/or interpreting, executing, and/or directing execution of one or more of the instructions, processes, and/or operations described herein. Processor 2604 may perform operations by executing computer-executable instructions 2612 (e.g., an application, software, code, and/or other executable data instance) stored in storage device 2606.

Storage device 2606 may include one or more data storage media, devices, or configurations and may employ any type, form, and combination of data storage media and/or device. For example, storage device 2606 may include, but is not limited to, any combination of the non-volatile media and/or volatile media described herein. Electronic data, including data described herein, may be temporarily and/or permanently stored in storage device 2606. For example, data representative of computer-executable instructions 2612 configured to direct processor 2604 to perform any of the operations described herein may be stored within storage device 2606. In some examples, data may be arranged in one or more databases residing within storage device 2606.

I/O module 2608 may include one or more I/O modules configured to receive user input and provide user output. I/O module 2608 may include any hardware, firmware, software, or combination thereof supportive of input and output capabilities. For example, I/O module 2608 may include hardware and/or software for capturing user input, including, but not limited to, a keyboard or keypad, a touchscreen component (e.g., touchscreen display), a receiver (e.g., an RF or infrared receiver), motion sensors, and/or one or more input buttons.

I/O module 2608 may include one or more devices for presenting output to a user, including, but not limited to, a graphics engine, a display (e.g., a display screen), one or more output drivers (e.g., display drivers), one or more audio speakers, and one or more audio drivers. In certain embodiments, I/O module 2608 is configured to provide graphical data to a display for presentation to a user. The graphical data may be representative of one or more graphical user interfaces and/or any other graphical content as may serve a particular implementation.

In some examples, any of the systems, hearing devices, computing devices, and/or other components described herein may be implemented by computing device 2600. For example, memory 102 may be implemented by storage device 2606 and processor 104 may be implemented by processor 2604.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A system comprising:

a memory storing instructions; and a processor communicatively coupled to the memory and configured to execute the instructions to generate a modified audiogram for a user of a hearing device, wherein the modified audiogram is based on a frequency lowering scheme, wherein:

the frequency lowering scheme maps at least some audio frequencies included in a first set of audio frequencies to relatively lower audio frequencies to form a second set of audio frequencies;

the modified audiogram indicates a set of modified hearing thresholds of the user at the first set of audio frequencies, which set of modified hearing thresholds is based on a set of hearing thresholds of the user at the second set of audio frequencies; and the generating of the modified audiogram includes applying an inverse of the frequency lowering scheme to the set of modified hearing thresholds at the second set of audio frequencies to obtain the set of modified hearing thresholds of the modified audiogram at the first set of audio frequencies.

2. The system of claim 1, wherein the generating of the modified audiogram further includes:

applying the frequency lowering scheme to a set of reference hearing thresholds at the first set of audio frequencies to obtain frequency lowered reference hearing thresholds at the second set of audio frequencies; and determining, based on the frequency lowered reference hearing thresholds and the set of hearing thresholds of the user at the second set of audio frequencies, the set of modified hearing thresholds at the second set of audio frequencies.

3. The system of claim 2, wherein the determining of the set of modified hearing thresholds includes:

determining a correction amount between the set of reference hearing thresholds at the second set of audio frequencies and the frequency lowered reference hearing thresholds at the second set of audio frequencies; and applying the correction amount to the set of hearing thresholds of the user at the second set of audio frequencies.

4. The system of claim 3, wherein the applying of the correction amount includes at least one of increasing at least some hearing thresholds included in the set of hearing thresholds of the user at the second set of audio frequencies or decreasing at least some hearing thresholds included in the set of hearing thresholds of the user at the second set of audio frequencies to determine the set of modified hearing thresholds for the user of the hearing device.

5. The system of claim 2, wherein the applying the frequency lowering scheme to the reference hearing threshold at the first set of audio frequencies to obtain the frequency lowered reference thresholds at the second set of audio frequencies includes performing a mapping from the second set of audio frequencies to the audiogram of the user.

6. The system of claim 5, wherein the applying of the inverse of the frequency lowering scheme includes performing an additional mapping from the set of modified hearing thresholds at the audiogram of the user to the first set of audio frequencies.

7. The system of claim 1, wherein the processor is further configured to execute the instructions to determine, based on the modified audiogram and an input frequency-based target gain generation model, one or more target gain values for the user of the hearing device.

8. The system of claim 7, wherein the determining of the one or more target gain values includes determining a target gain curve that represents a target gain profile for useable gain by the hearing device across the first set of audio frequencies.

9. The system of claim 8, wherein the processor is further configured to execute the instructions to correct an amplitude of a portion of the target gain curve by an amount to compensate for a change of bandwidth related energy associated with the applying of the inverse of the frequency lowering scheme.

10. The system of claim 8, wherein:

the target gain curve includes a plurality of target gain curves;

each target gain curve included in the plurality of target gain curves represents a different target gain profile for the useable gain by the hearing device across the first set of audio frequencies; and each target gain curve included in the plurality of target gain curves corresponds to a different sound input level included in a plurality of sound input levels.

11. The system of claim 1, wherein the processor is further configured to execute the instructions to optimize an amount of frequency lowering applied by way of the frequency lowering scheme.

12. The system of claim 11, wherein the optimizing of the amount of the frequency lowering includes optimizing the amount of the frequency lowering based on the modified audiogram.

13. The system of claim 1, wherein the frequency lowering scheme corresponds to a frequency compression scheme.

14. A system for fitting a hearing device to a user, the system comprising:

a memory storing instructions; and a processor communicatively coupled to the memory and configured to execute the instructions to:

access a modified audiogram for the user of the hearing device, wherein the modified audiogram is based on a frequency lowering scheme that maps at least some audio frequencies included in a first set of audio frequencies to relatively lower audio frequencies to form a second set of audio frequencies, the modified audiogram indicating a set of modified hearing thresholds of the user at the first set of audio frequencies, which set of modified hearing thresholds is based on a set of hearing thresholds for the user at the second set of audio frequencies, wherein:

the modified audiogram is generated by:

applying the frequency lowering scheme to a set of reference hearing thresholds at the first set of audio frequencies to obtain frequency lowered reference hearing thresholds at the second set of audio frequencies;

determining, based on the frequency lowered reference hearing thresholds and the set of hearing thresholds of the user at the second set of audio frequencies, the set of modified hearing thresholds at the second set of audio frequencies; and applying an inverse of the frequency lowering scheme to the set of modified hearing thresholds at the second set of audio frequencies to obtain the set of modified hearing thresholds of the modified audiogram at the first set of audio frequencies;

determine, based on the modified audiogram and an input frequency-based target gain generation model, one or more target gain values for the user of the hearing device; and fit the hearing device to the user based on the one or more target gain values.

15. The system of claim 14, wherein the determining of the one or more target gain values includes determining a target gain curve that represents a target gain profile for useable gain by the hearing device across the first set of audio frequencies.

16. The system of claim 15, wherein the processor is further configured to execute the instructions to correct an amplitude of a portion of the target gain curve by an amount to compensate for a change of bandwidth related energy associated with the applying of the inverse of the frequency lowering scheme.

17. The system of claim 15, wherein:

the target gain curve includes a plurality of target gain curves;

each target gain curve included in the plurality of target gain curves represents a different target gain profile for the useable gain by the hearing device across the first set of audio frequencies; and each target gain curve included in the plurality of target gain curves corresponds to a different sound input level included in a plurality of sound input levels.

18. A method for fitting a hearing device to a user, the method comprising:

accessing, by a processor, a modified audiogram for the user of the hearing device, wherein:

the modified audiogram is based on a frequency lowering scheme that maps at least some audio frequencies included in a first set of audio frequencies to relatively lower audio frequencies to form a second set of audio frequencies;

the modified audiogram indicates a set of modified hearing thresholds of the user at the first set of audio frequencies, which set of modified hearing thresholds is based on a set of hearing thresholds for the user at the second set of audio frequencies; and the modified audiogram is generated by:

applying the frequency lowering scheme to a set of reference hearing thresholds at the first set of audio frequencies to obtain frequency lowered reference hearing thresholds at the second set of audio frequencies;

determining, based on the frequency lowered reference hearing thresholds and the set of hearing thresholds of the user at the second set of audio frequencies, the set of modified hearing thresholds at the second set of audio frequencies; and applying an inverse of the frequency lowering scheme to the set of modified hearing thresholds at the second set of audio frequencies to obtain the set of modified hearing thresholds for the modified audiogram at the first set of audio frequencies;

determining, by the processor and based on the modified audiogram and an input frequency-based target gain generation model, one or more target gain values for the user of the hearing device; and fitting, by the processor, the hearing device to the user based on the one or more target gain values.

19. The method of claim 18, further comprising generating, by the processor, the modified audiogram.

20. The method of claim 18, wherein the determining of the one or more target gain values includes determining a target gain curve that represents a target gain profile for useable gain by the hearing device across the first set of audio frequencies.

* * * * *